US010293993B2

(12) United States Patent
Rohr et al.

(10) Patent No.: US 10,293,993 B2
(45) Date of Patent: May 21, 2019

(54) UNIVERSAL DOMED CLOSURE TO SUPPLY DOSE

(75) Inventors: Robert D. Rohr, LaOtto, IN (US); Richard A. Laveault, Cypress, TX (US); Derek D. Hopkins, Deerfield, NH (US); Kenneth E. Milligan, Harrisville, RI (US)

(73) Assignee: Liquid Health Labs, Inc., Deerfield, NH (US)

( * ) Notice: Subject to any disclaimer, the term of this patent is extended or adjusted under 35 U.S.C. 154(b) by 0 days.

(21) Appl. No.: 13/508,329

(22) PCT Filed: Nov. 5, 2010

(86) PCT No.: PCT/US2010/055690

§ 371 (c)(1),
(2), (4) Date: May 4, 2012

(87) PCT Pub. No.: WO2011/057111

PCT Pub. Date: May 12, 2011

(65) Prior Publication Data

US 2012/0217178 A1 Aug. 30, 2012

Related U.S. Application Data

(60) Provisional application No. 61/373,518, filed on Aug. 13, 2010, provisional application No. 61/258,319, filed on Nov. 5, 2009.

(51) Int. Cl.

| | |
|---|---|
| ***B65D 51/00*** | (2006.01) |
| ***B65D 51/28*** | (2006.01) |
| ***B65D 41/04*** | (2006.01) |

(52) U.S. Cl.
CPC ..... *B65D 51/2864* (2013.01); *B65D 41/04* (2013.01)

(58) Field of Classification Search
CPC ..... B65D 51/2864; B65D 51/2878; B65D 85/00; B65D 41/3428; B65D 41/3442
(Continued)

(56) References Cited

U.S. PATENT DOCUMENTS 2,764,157 A 9/1956 Oliva et al.
2,764,983 A 10/1956 Pius et al.
(Continued)

FOREIGN PATENT DOCUMENTS

EP 0251259 A1 1/1988
FR 2565939 A1 12/1985
(Continued)

OTHER PUBLICATIONS

English Language abstract for Japanese Pat. Appl. Pub. No. 2008518858.
(Continued)

*Primary Examiner* — Ernesto Grano
(74) *Attorney, Agent, or Firm* — Nevrivy Patent Law Group P.L.L.C.

(57) ABSTRACT

The present invention relates to a universal closure capable of fitting various sized container openings in sealed engagement The present invention also relates a universal dispensing closure capable of fitting various sized container openings in sealed engagement and used to house a secondary supply or dose of product and when the closure is activated dispense the secondary product or dose into a receiving vessel to which it is attached.

41 Claims, 14 Drawing Sheets

(58) Field of Classification Search
USPC ..... 206/219, 221, 222; 215/DIG. 8
See application file for complete search history.

(56) References Cited

U.S. PATENT DOCUMENTS

| | | | | |
|---|---|---|---|---|
| 2,813,649 | A | 11/1957 | Lipari | |
| 3,347,410 | A * | 10/1967 | Schwartzman | 222/80 |
| 3,441,179 | A | 4/1969 | Ragan | |
| 3,539,794 | A | 11/1970 | Kennerly et al. | |
| 4,103,772 | A | 8/1978 | Wiegner | |
| 4,221,291 | A | 9/1980 | Hunt | |
| 4,463,862 | A | 8/1984 | Hansen | |
| 4,671,420 | A | 6/1987 | Marcus | |
| 4,770,305 | A | 9/1988 | Su | |
| 4,886,175 | A | 12/1989 | Schlaudecker | |
| 5,054,267 | A | 10/1991 | Dundas | |
| 5,188,250 | A | 2/1993 | Kovacic et al. | |
| 5,373,937 | A | 12/1994 | Lamboy | |
| 5,542,528 | A | 8/1996 | Lanfranconi et al. | |
| 5,839,573 | A * | 11/1998 | Morini | 206/221 |
| 5,853,109 | A | 12/1998 | Elliott | |
| 5,950,819 | A | 9/1999 | Sellars | |
| 5,979,164 | A | 11/1999 | Scudder et al. | |
| 6,003,728 | A | 12/1999 | Elliott | |
| 6,257,428 | B1 | 7/2001 | Caola | |
| 6,257,463 | B1 | 7/2001 | De Polo | |
| 6,302,268 | B1 | 10/2001 | Michaeli | |
| 6,325,226 | B1 | 12/2001 | Krautkramer | |
| 6,435,341 | B1 * | 8/2002 | Nobbio | B65D 41/3442 206/219 |
| 6,513,650 | B2 * | 2/2003 | Mollstam | A61J 9/00 206/219 |
| 6,786,330 | B2 * | 9/2004 | Mollstam | B65D 47/2031 206/219 |
| 6,886,686 | B2 | 5/2005 | Anderson | |
| 7,055,684 | B2 | 6/2006 | Anderson | |
| 7,503,453 | B2 | 3/2009 | Cronin | |
| 7,568,576 | B2 | 8/2009 | Sweeney et al. | |
| 7,703,642 | B2 | 4/2010 | Scott | |
| 7,874,420 | B2 | 1/2011 | Coon | |
| 8,490,786 | B2 | 7/2013 | Rohr | |
| 8,770,399 | B2 * | 7/2014 | Hjalmarsson | B65D 51/2821 206/219 |
| 2002/0066748 | A1 | 6/2002 | Weiler et al. | |
| 2003/0213709 | A1 | 11/2003 | Gibler et al. | |
| 2004/0026270 | A1 * | 2/2004 | Liang | B65D 51/2821 206/219 |
| 2004/0026422 | A1 | 2/2004 | Westphal | |
| 2004/0050881 | A1 | 3/2004 | Deussen | |
| 2005/0184090 | A1 | 8/2005 | DeJonge | |
| 2005/0263414 | A1 | 12/2005 | Harilela et al. | |
| 2006/0118435 | A1 | 6/2006 | Cronin et al. | |
| 2007/0102306 | A1 | 5/2007 | Lantos | |
| 2008/0073307 | A1 | 3/2008 | Sweeney | |
| 2008/0179331 | A1 | 7/2008 | Sharp | |
| 2008/0245797 | A1 * | 10/2008 | Berge | A01M 1/2005 220/305 |
| 2008/0290061 | A1 | 11/2008 | Seelhofer | |
| 2009/0057262 | A1 | 3/2009 | Cho | |
| 2009/0139882 | A1 | 6/2009 | DeJonge | |
| 2009/0260999 | A1 * | 10/2009 | Yang et al. | 206/219 |
| 2009/0308831 | A1 | 12/2009 | Anderson | |
| 2010/0200437 | A1 | 8/2010 | Coon | |
| 2011/0166910 | A1 | 7/2011 | Marina | |
| 2011/0174642 | A1 * | 7/2011 | Coon | B65D 51/2835 206/222 |
| 2013/0140198 | A1 | 6/2013 | Rohr | |
| 2014/0053942 | A1 | 2/2014 | Rohr | |

FOREIGN PATENT DOCUMENTS

| | | | |
|---|---|---|---|
| FR | 2885356 | A1 | 11/2006 |
| GB | 698914 | A | 10/1953 |
| GB | 1004473 | A | 9/1965 |
| JP | 1976122850 | | 10/1976 |
| JP | 1980145460 | | 10/1980 |
| JP | 1993058655 | | 8/1993 |
| JP | 08-072849 | A | 3/1996 |
| JP | 1997058716 | A | 3/1997 |
| JP | 2001055259 | A | 2/2001 |
| JP | 2002120853 | | 4/2002 |
| JP | 2002211607 | A | 7/2002 |
| JP | 2005187022 | A | 7/2005 |
| JP | 2006089084 | | 6/2006 |
| JP | 2007276786 | A | 10/2007 |
| JP | 2008518858 | A | 6/2008 |
| KR | 20030027931 | A | 4/2003 |
| KR | 10-2004-0103234 | A | 12/2004 |
| KR | 10-2007-0085762 | A | 8/2007 |
| WO | 9317928 | A1 | 9/1993 |
| WO | 9505321 | A1 | 2/1995 |
| WO | 2006046730 | A1 | 5/2006 |
| WO | 2006052827 | A2 | 5/2006 |
| WO | 2006123946 | | 11/2006 |
| WO | 2009127039 | A1 | 10/2009 |
| WO | 2011099995 | A1 | 8/2011 |

OTHER PUBLICATIONS

English Language abstract for Japanese Pat. Appl. Pub. No. 2007276786.
U.S Office Action from U.S. Appl. No. 12/658,295, dated Mar. 29, 2011.
U.S Office Action from U.S. Appl. No. 12/658,295, dated Oct. 18, 2011.
U.S Office Action from U.S. Appl. No. 12/658,295, dated Aug. 15, 2012.
U.S Office Action from U.S. Appl. No. 12/658,295, dated Dec. 27, 2012.
U.S Office Action from U.S. Appl. No. 13/577,490, dated Dec. 22, 2015.
U.S Office Action from U.S. Appl. No. 13/577,490, dated Dec. 1, 2016.
U.S Office Action from U.S. Appl. No. 13/577,490, dated Jun. 23, 2017.
U.S Office Action from U.S. Appl. No. 13/577,490, dated May 14, 2018.
U.S Office Action from U.S. Appl. No. 13/947,545, dated Nov. 5, 2014.
U.S Office Action from U.S. Appl. No. 13/947,545, dated May 27, 2015.
U.S Office Action from U.S. Appl. No. 13/947,545, dated Feb. 3, 2016.
U.S Office Action from U.S. Appl. No. 13/947,545, dated Sep. 9, 2016.
English Language abstract for Japanese Pat. Appl. Pub. No. 2005187022.
English Language abstract for Japanese Pat. Appl. Pub. No. 2002120853.
English Language abstract for Japanese Pat. Appl. Pub. No. 1997058716.
International Search Report from Appl. No. PCT/US2010/055690, dated Jul. 12, 2011.
English Language abstract for Japanese Pat. Appl. Pub. No. 2001055259.
English Language abstract for Japanese Pat. Appl. Pub. No. 2002211607.
Office Action from Japanese Appl. No. 2012-537235, dated Feb. 10, 2015.
English translation of Japanese Office Action from JP Pat. Appl. No. 2012-537235.

* cited by examiner

UNIVERSAL DOMED CLOSURE TO SUPPLY DOSE

CROSS REFERENCE TO RELATED APPLICATIONS

This application claims the benefit of U.S. Provisional Appl. Nos. 61/258,319 and 61/373,518, filed Nov. 5, 2009 and Aug. 13, 2010, respectively, the contents of which are incorporated by reference herein in their entirety.

BACKGROUND OF THE INVENTION

Field of the Invention

This invention relates generally to the field of packages and containers, and in particular, pertains to a container closure device capable of fitting multiple container opening sizes to provide a sealing and retaining method for dispension of a product from the closure into a receiving container.

Background

Current market conditions for flat water and other like beverage products are such that manufacturers and suppliers of these beverages have a variety of openings or neck finishes of various dimensions. These openings are unique and require a specific threaded closure to accommodate a shipping and long term storage seal. It is desirable to allow the temporary or long term placement of a one-fit-all closure to fit these various sized container openings. It is desirable to fit a closure device to the top of multiple sized container openings, like beverage bottles, to supply a predetermined dose of product. It is desirable to have a universal closure capable of dispensing a product stored therein through the various sized container openings without spilling or contamination. It is also an advantage to provide a sealing and retaining method once the dose or supply of product has been delivered to the receiving container. It is desirable to have a universal closure act in sealing engagement to the container opening at the point of use allowing the end user to shake ingredients to mix thoroughly and travel about with the closure without spilling of the contents therein.

SUMMARY OF THE INVENTION

A first aspect of the invention provides a universal closure capable of fitting various sized container openings or neck finishes in sealed engagement. The universal closure of this invention is capable of providing sealing engagement with the neck or opening of a container to retain product in the container without spilling or contamination. In one embodiment there is a proximal top, distal annular edge, side walls having an inner and outer diameter and a flexible deformable depending radial protrusion of varying dimension in the inner diameter of the closure provides sealing engagement to the opening or neck of a container with differing diameters. In another embodiment there is a proximal top, distal annular edge, peripheral side walls having an inner and outer diameter and more than one flexible deformable depending rib placed in separation provide application and removal torque. In another embodiment there the universal closure comprises a proximal top, distal annular edge, peripheral side walls and a radial plug seal depending from the underside of the proximal top. The universal closure may further comprise more than one spacer rib, more than one thread engagement lug, and one or more thinning ribs. The universal closure of this invention can be pressed on to a container neck finish or screwed on to a container by which deformable ribs and/or radial protrusions and/or spacer ribs or thread engagement lugs engage and interfere with the container threads, and/or a plug seal interferes with the inside diameter of a container neck, to provide removal resistance and sealing engagement.

It is another aspect of the invention to provide a method of closing the neck or opening of a container comprising attaching the universal closure device of the present invention to the neck of a container in need of sealing closure.

Another aspect of the invention provides a universal dispensing closure device capable of housing, storing and carrying a dose or supply of product until a desired point of use as determined by the end user. The universal closure dispensing device of the present invention comprises a housing having a dose chamber to retain product and a user-actuated means for dispensing the product, and a closure radial skirt for sealing engagement with a neck or opening of a container to receive the product.

It is another aspect of the invention to provide a method of supplying or dosing a product comprising attaching the universal closure device of the present invention to the neck of a container and dispensing product therein according to the user-actuated means described herein.

It is another aspect of the invention to provide a point of use universal dispensing device that indicates to the end user whether inadvertent dispension or tampering with the product has occurred. In some embodiments of the universal closure dispensing devices of the present invention there are one or more of the tamper evident (TE) components that indicate premature dispensing and/or tampering, including (i) radial hinges on the inner surface of the convex dome to maintain the inverted concave configuration of the dome after being pressed, thereby indicating actuation and possible premature dispension or tampering, (ii) a tamper evident skirt attached to the distal annular edge of the closure radial skirt by a break-away attachment that cannot be removed from a receiving vessel without breaking the break-away attachment, (iii) a fold away tab or truss attached to the outer diameter of the press part by a break-away tab; a detached break-away tab is an indication of tampering.

Another aspect of the invention is to provide a point-of-use universal dispensing device that protects against accidental dispension. In some embodiments of the universal dispensing closure there are dispension-preventative components that provide protection from inadvertent, accidental or premature dispensing, including (i) a fold away tab or truss that straddles the outer surface diameter of the press part to prevent inadvertent activation and dispension, (ii) a standing radial rim connected to the proximal radial edge of the housing and surrounding the press part beyond the proximal top of the press part to prevent inadvertent activation and dispension, and/or (iii) a protective overcap covering the press part.

It is another aspect of the invention to provide a point of use universal dispensing device that retains the integrity and freshness of ingredients until dispension.

Other aspects and advantages of the present invention will become apparent from the following descriptions, taken in connection with the accompanying drawings, wherein, by way of illustration and example, an embodiment of the present invention is disclosed.

BRIEF DESCRIPTION OF THE FIGURES

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 29 further illustrates an end cap 35, a foil liner 36, and a plug seal 12.

FIG. 30 also illustrates a closure radial skirt 27 having finger recess elements 46 and a tamper evident skirt 62 with a pull tab 63.

FIG. 35 also identifies a flexible dome 23, septum 40 and end cap 35.

DETAILED DESCRIPTION OF THE INVENTION

Detailed descriptions of embodiments of the invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Universal Closure

Figure 21:
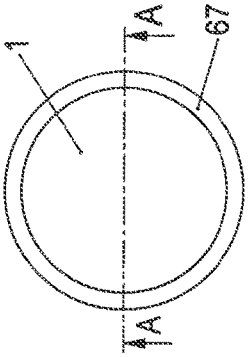
FIG. 21: Top view of a universal closure device.
Figure 13:
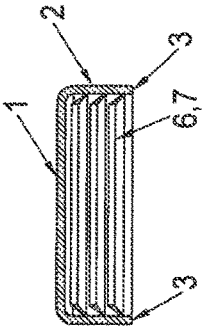
FIG. 13: Cross section view of a universal closure with flexible deformable rings 7.

In one aspect the present invention relates to novel closure devices (FIGS. 13-21) capable of providing sealing engagement with a variety of container neck finishes and container opening sizes of containers. The closure has a proximal top 1, peripheral side walls 2 and distal annular edge 3. The proximal top 1 in one embodiment is substantially flat and in other embodiments, the proximal top 1 has a slope of varying degrees. In one embodiment, the proximal top 1 is connected to the side walls 2 by an internal rounded corner or fillet radii. FIG. 21 shows the outer annular edge of the fillet radii 67. The side walls have an inner diameter 4 and outer diameter 5. In one embodiment, the inner diameter 4 of the side walls and the outer diameter 5 of the sidewalls are substantially the same along their respective length from the proximal end to the distal end of the sidewalls 2. In other embodiments, there are more than one of each of the inner diameter 4 and outer 5 diameter from the proximal end of the side walls 2 to the distal end of the side walls 2. The side walls 2 are also referred to as the skirt of the universal closure. In one embodiment the side walls 2 are curved to give the closure a generally tubular shape. The tubular shape of the universal closure may be conical including any tapered tubular form or cylindrical including an elliptic cylinder shape, parabolic cylinder shape, hyperbolic cylinder shape, circular cylinder shape and generalized cylinder (in which the cross-section may be any curve) shape. In another embodiment, the inner diameter 4 of the side walls 2 is curved and the outer diameter 5 of the side walls is angular.

Figure 14:
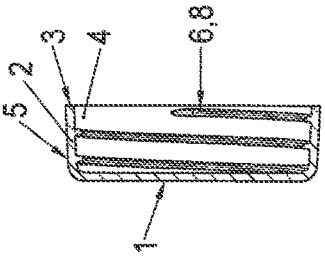
FIG. 14: Cross section view of a universal closure with deformable helix 8.
Figure 26:
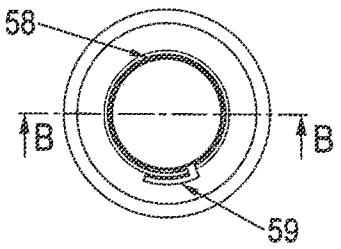
FIG. 26: Top view of a universal inverted dome dispensing closure showing with a removable standing radial rim 58 with a tear-away pull tab 59.

In some embodiments, the inner diameter 4 of the side walls 2 further comprises one or more deformable depending protrusions 6 of varying dimension to provide a one-fit-many aspect of the universal closure device of the present invention. The deformable depending protrusions 6 are thin, flexible and deformable such that the closure can accept a variety of threaded neck and opening diameters and thread profiles. The one or more deformable depending protrusions 6 provide application and removal torque. In one embodiment, the one or more deformable depending protrusions comprise radial rings 7, helix 8 or combinations thereof. In one embodiment as shown in FIG. 14, the universal closure has threads on the internal side walls capable of being rotatably coupled to a container neck. The threads may be of a variety of configurations and/or helix or pitch. In some embodiments, the helix has a pitch from about 0 degrees to about 10 degrees. In other embodiments the helix has a pitch greater than 0 degrees to about 4 degrees. In another embodiment, the one or more deformable depending protrusions 6 comprise more than one axial rib including vertical ribs 9, angled ribs 10, arced ribs 11, various other shapes or geometries, or combinations thereof. In other embodiments the one or more deformable depending protrusions comprise more than one radial rib, including horizontal ribs, angled ribs, arced ribs, various other shapes or geometries, or combinations thereof. In other embodiments, the deformable depending protrusions comprise a combination of radial rings, helix, axial ribs or radial ribs.

The deformable ribs (e.g., 9, 10, 11) are placed in separation on the inner diameter to provide application and removal torque. The axial ribs are compliant through their vertical length and will shear readily from the top wall to provide a hinged deformable member with the side wall of the closure. The axial ribs are attached to the underside proximal top end of the closure for manufacturing purposes. The axial ribs are designed in such a manner that the proximal end tears or breaks away from the closure when the closure is being applied to a container. Attachment at the underside of the proximal top 1 is in one embodiment sharp such that is there is no fillet radii. In another embodiment, there is a small fillet radii where the side walls 2 meet the underside of the proximal top 1 as long as it will not interferingly engage with the bottle neck when the closure is applied.

In some embodiments, the depth of a deformable depending protrusion from the side wall can range from about 0.005 to about 1.0 inches. In one embodiment, the depth from the side wall is about 0.040 inches. In some embodiments, the thickness of an axial rib is from about 0.005 inches to about 0.050 inches. In one embodiment, the thickness of the axial rib is about 0.020 inches.

In another embodiment, the universal closure inner comprises a proximal top 1, side walls 2, distal annular edge 3 and a depending plug seal 12. The inner diameter 4 of the side wall 2 is non-threaded and has no deformable depending protrusions of varying dimensions 6-11. In other embodiments, there is more than one spacer rib, and/or more than one thread engagement lug, each as described below.

Plug Seal

Figure 7:
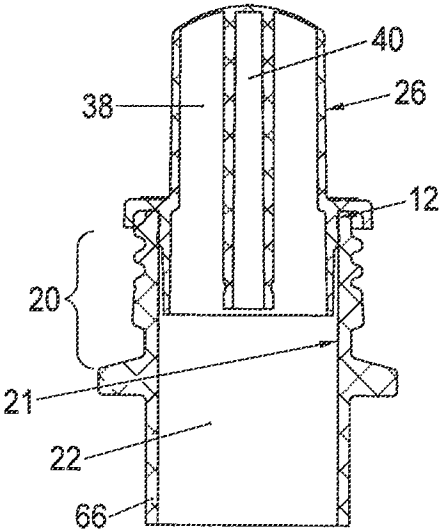
FIG. 7: Cross section view of the plug sealing means formed integral with the outer diameter 33 of the side walls 30 of the housing tube 26 in partial assembly with a container neck 20.

As shown in FIGS. 4, 5, 7, 12 29, and 35-36 the universal closure in some embodiments also comprises a depending radial flexible plug like sealing member 12 that fits to the inner diameter 21 of a container neck 20. This plug seal 12 is unique in its configuration such that it provides sealing engagement opportunities to a multiplicity of neck finish inner diameters. As shown in FIG. 7, the plug seal protrudes inside the opening of a container 22 keeping its contents secure from leakage. The plug seal 12 is designed to have interfering engagement with the inner diameter of the opening of a container neck 21 such that it seals the contents of the container from leaking out and still allows sufficiently low application and removal forces to be readily applied and removed by the end user.

Figure 5:
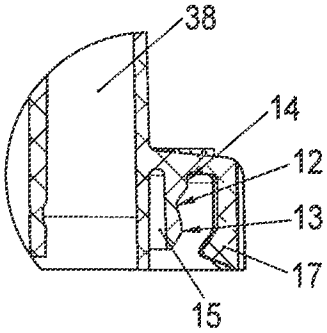
FIG. 5: Close-up view of the plug seal 12 of varying cross sectional thickness.
Figure 36:
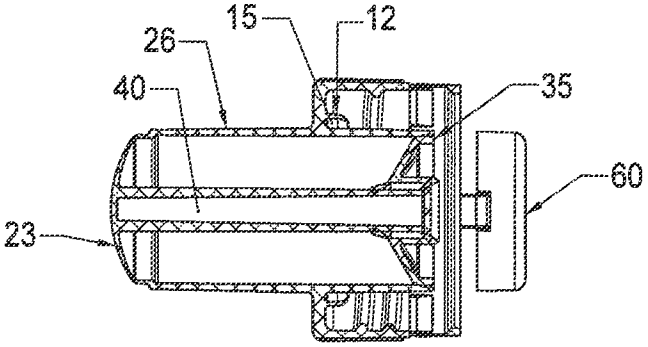
FIG. 36: Cross section view of a flexible dome closure with integral protective overcap 60 in open position.
Figure 35:
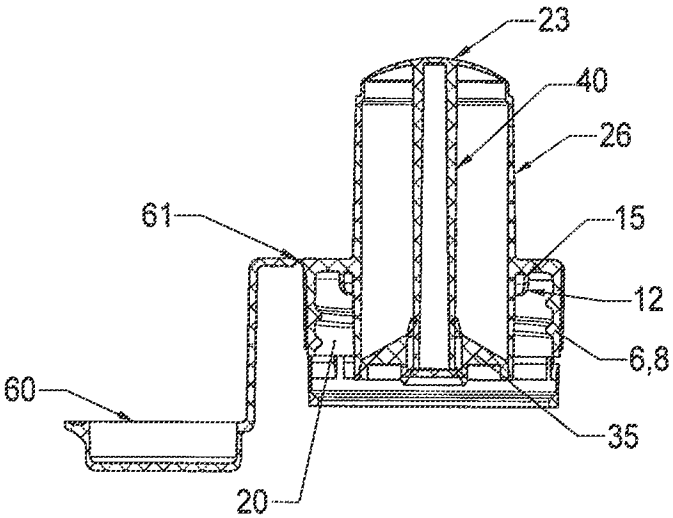
FIG. 35: Cross section view through hinge area 61 of a flexible dome closure with integral protective overcap 60 in open position.
Figure 33:
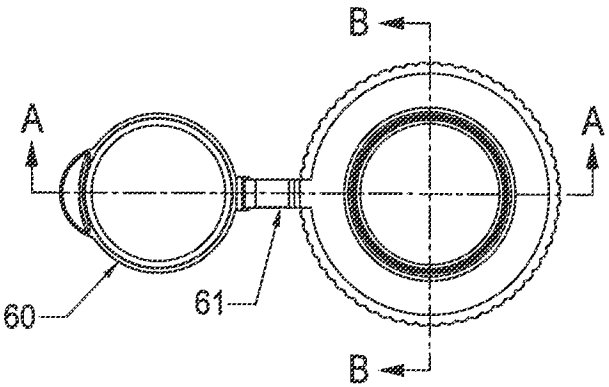
FIG. 33: Top view of a flexible dome closure with integral protective over cap 60 in open position
Figure 34:
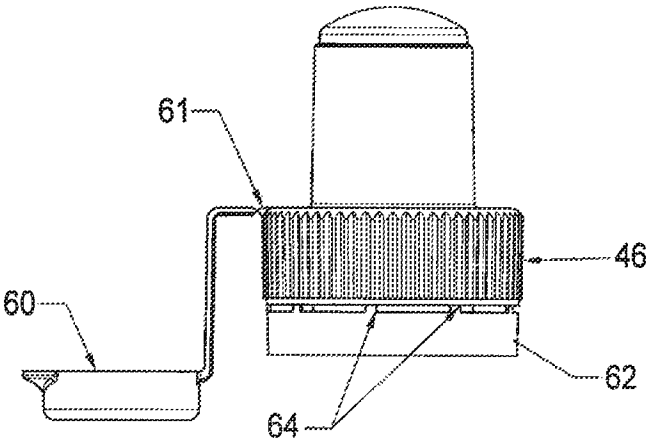
FIG. 34: Side view of a flexible dome closure with integral protective overcap 60 in the open position.

The plug seal depends from the underside of the proximal top 1 of the closure. The dimensions of the plug seal 12 may vary. In some embodiments, the plug seal 12 has a longer and thinner lower or distal section 13 that can be readily folded or deformed out of location providing interfering engagement for larger inner diameter bottles and a thicker upper or proximal radial sealing section 14 for smaller inner diameter bottles (FIG. 5). In some embodiments, the plug seal 12 has a smaller diameter at its distal end with increasing diameter moving toward the deck of the closure radial skirt (FIGS. 35 and 36). The configuration of the plug seal 12 can be bean-shaped, angular or other shapes and geometries to provide interfering sealing engagement for container necks with openings of a smaller inner diameter at the lower distal end of the plug seal and interfering sealing engagement for container necks with openings of a larger inner diameter at the upper proximal end of the plug seal (e.g., FIGS. 24, 27).

In some embodiments, the length of the plug seal 12 from its proximal end to the distal end is substantially the same length as the side walls 2 such that the distal edge of the internal closure diameter 12 is substantially flush with the distal annular edge 3 of the side walls 2. In other embodiments, the length of the plug seal 12 from its proximal end to the distal end is less than that of the side walls 2.

In some embodiments as shown in FIG. 5, the plug seal 12 creates an internal spacing diameter 15 that allows the plug seal to bend and conform to varying container neck finishes and diameters. The internal spacing diameter 15 spans from the inner diameter of the plug seal to the outer diameter of the housing tube within the closure side walls 2. The width of the internal spacing diameter 15 may vary to provide interfering engagement with varying inside diameters of container necks 20. In another embodiment, the plug seal is formed integral with the outer diameter 33 of the side wall 30 of the housing tube 26 (FIG. 7).

Figure 49:
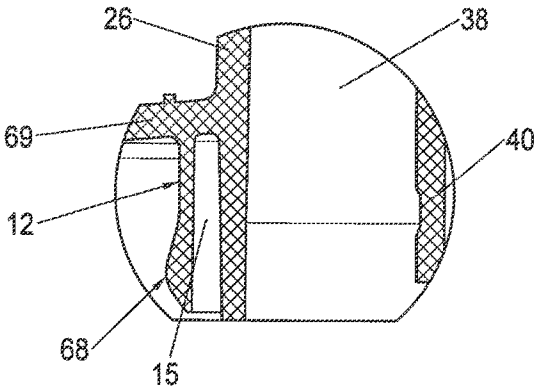
FIG. 49: Close-up view of one embodiment of plug seal 12.
Figure 48:
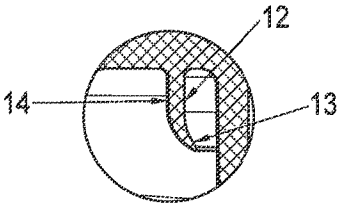
FIG. 48: Close-up view of one embodiment of plug seal 12.

In another embodiment, there is a plurality of sealing beads 68 (FIG. 49) at varied positions on the plug seal. The sealing beads 68 are radial bumps that interferingly engage the inner diameter of the opening of a container to close the opening. The sealing beads are positioned at various locations and of varying sizes to engage the neck or opening of a container of various sizes. In one embodiment, the sealing beads are of a smaller size at the distal end of the plug and increase in size moving toward the proximal top of the seal plug. The sealing beads work such that if a closure does not go all the way down to engage the top of the neck or opening of a container, then a set of sealing beads engage the internal diameter of the opening or neck of a container to create a seal and close the opening. In one embodiment, the smaller and more distal sealing beads will engage the inner diameter of smaller openings and the larger more proximal sealing beads engage the inner diameter of larger openings.

Spacer Rib

As shown in FIGS. 4, 5, 8 and 9, the universal closure may also comprise more than one spacer rib 16 used to provide interfering engagement without increasing radial torque. The spacer ribs 16 are connected to the inner diameter 14 of the side walls 2 and in one embodiment diametrically opposed (FIG. 10) which allows the thread to fit in between the protrusions 6-11 allowing the closure skirt 2 to conform to an oval shape 20. In other embodiments, the spacer ribs are spaced apart from each other. The vertical position of the spacer ribs on the inner diameter is important to provide vertical interference with the outer diameter of the container neck 20 finish thread. The spacer 16 ribs in one embodiment are situated to mate with the inside proximal top 1. In another embodiment, the spacer ribs 16 are situated below the proximal top 1. The width of a spacer rib 16 should be in the range of about 20 mm to about 28 mm for closure devices fitting about 26 mm to about 28 mm container neck or opening sizes. The length of a spacer rib 16 should be in the range of about 2 mm to about 20 mm for closure devices fitting about 26 mm to about 28 mm container neck or opening sizes. For larger diameter container neck or opening sizes there are, in some embodiments, larger dimensioned spacer ribs. In some other embodiments, there are more than two spacer ribs for larger diameter container necks or opening sizes. As the size of the container neck increases, more spacer ribs provide more interference with the container neck to secure the universal closure and to prevent the closure from disengaging upon shaking.

Thread Engagement Lug

Figure 8:
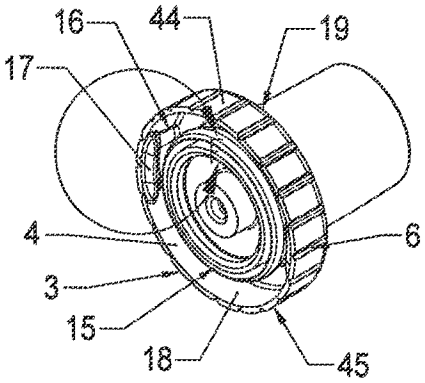
FIG. 8: Bottom perspective of a spacer rib 16 in alignment with a thread engagement lug 17 and thread engagement means.
Figure 9:
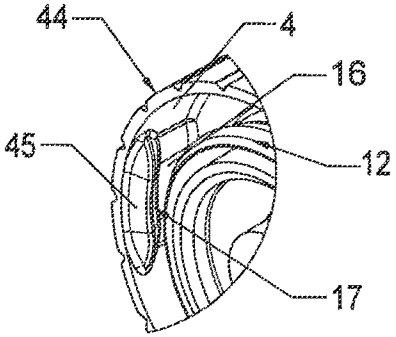
FIG. 9: Close-up view of a spacer rib 16 and thread engagement lug 17 in alignment.
Figure 12:
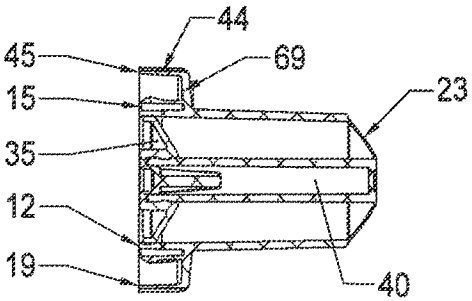
FIG. 12: Section view in assembly showing the thin wall section that exists at the root of the thinning rib 19 to provide flexibility into the closure.
Figure 10:
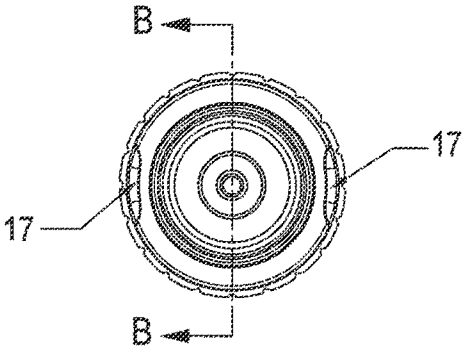
FIG. 10: Bottom view of universal closure with thread engagement lugs 17 spaced apart to receive a variety of neck finish sizes and thread configurations and thread helix angles.
Figure 6:
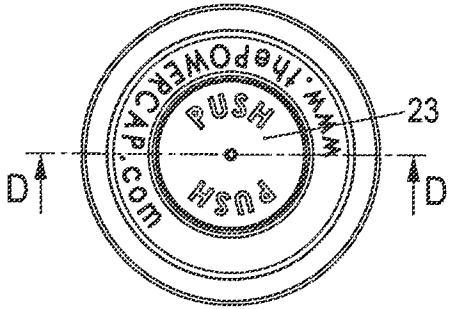
FIG. 6: Top view on a plug sealing means formed integral with the outer diameter of the side walls of the housing tube.

As illustrated in FIGS. 4, 5, 8-10, the universal closure may also comprise more than one thread engagement lug 17 used to meet and provide interfering engagement with a variety of thread configurations and helix of varying pitch of the container neck engaged by the universal closure. The thread engagement lugs 17 are connected to the inner diameter 4 of the side walls 2 and in one embodiment diametrically opposed (FIG. 10). In other embodiments, the thread engagement lugs 17 are spaced apart from each other. The radial spacing between the thread engagement lugs allows the closure skirt 2 to deform during application to a container neck 20. The vertical and radial positions of thread engagement lugs are defined such that they will engage threads on a variety of neck finishes within a range. The thread engagement lugs can be in horizontal alignment or off set vertically and radially to provide optimal thread to neck finish engagement. For larger diameter container neck or opening sizes there are, in some embodiments, larger dimensioned thread engagement lugs. In some other embodiments, there are more than two thread engagement lugs for larger diameter container necks or opening sizes. As the size of the container neck increases, more thread engagement lugs provide more interference with the container neck to secure the universal closure and to prevent the closure from disengaging upon shaking.

Figure 45:
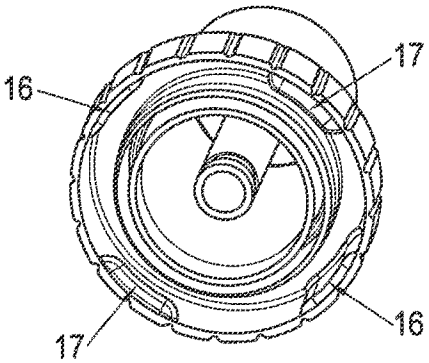
FIG. 45: Perspective view of universal dispensing closure device showing spacer ribs 16 and thread engagement lugs 17 not in alignment.
Figure 44:
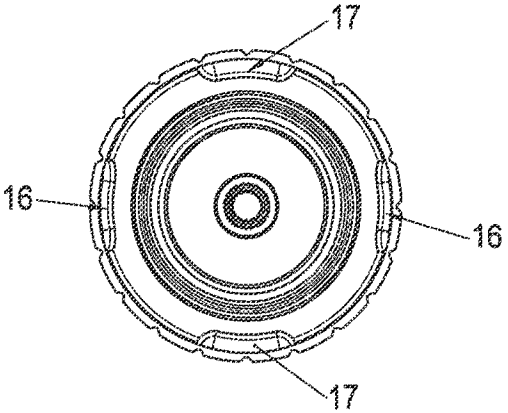
FIG. 44: Bottom view of universal dispensing closure device showing spacer ribs 16 and thread engagement lugs 17 not in alignment.

FIGS. 8-10 show the thread engagement lug 17 in radial alignment with the spacer rib 16 on the inner diameter of the universal closure. The spacer rib however occupies different vertical space from the thread engagement lug. The spacer rib 16 is more proximal in relation to the position of the thread engagement lug 17 which is more distally situated. In other embodiments, the thread engagement lugs are not radially aligned with the spacer ribs, and appear in overlapping or alternating positions along the radial inner diameter while still maintaining different vertical space (FIGS. 44 and 45). The radial spacing between the thread engagement lugs and the spacer ribs allows the closure skirt 2 to deform during application to a container neck 20.

Spacing Diameter

As illustrated in FIG. 8, the universal closure comprises in some embodiments a spacing diameter 18 that provides clearance for the neck of a container 20 engaged by the universal closure. The spacing diameter allows for the plug seal to move as needed for a proper fit. The spacing diameter spans from the inner diameter 4 of the sidewalls 2 to the outer diameters of the plug seal. For larger diameter container neck or opening sizes, in some embodiments, the spacing diameter is larger sized.

Thinning Ribs

Figure 11:
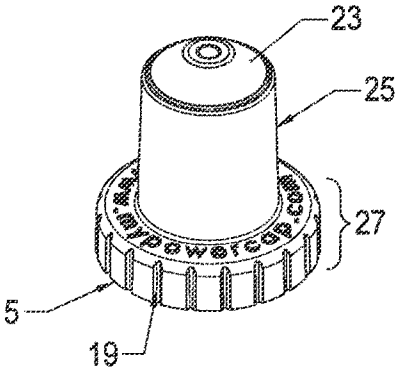
FIG. 11: A perspective view indicating the thinning ribs 19 run circumferentially about the skirt on the closure.
Figure 2:
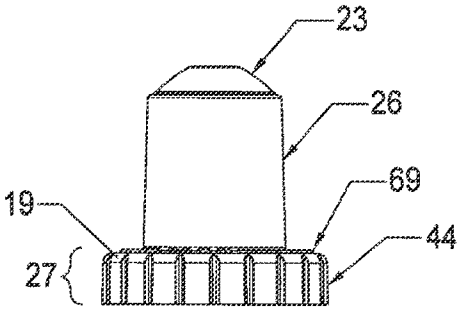
FIG. 2: Front view of one embodiment of a universal inverted dome closure.
Figure 3:
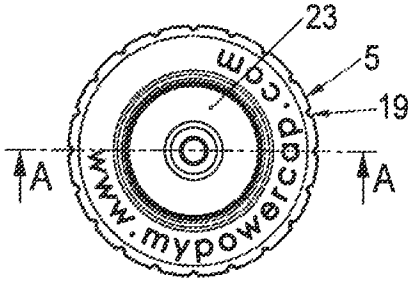
FIG. 3: Top view of the plug seal of varying cross sectional thickness.
Figure 4:
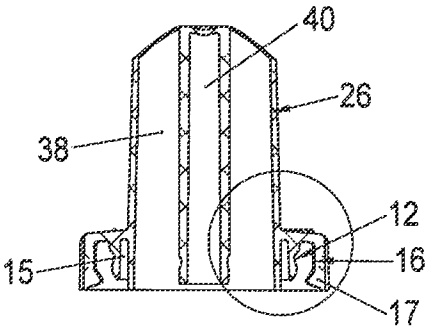
FIG. 4: Cross section view of the plug seal 12 of varying cross sectional thickness.
Figure 19:
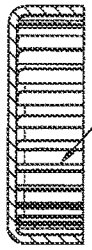
FIG. 19: Cross section view of a universal closure with flexible deformable vertical arced ribs 11.
Figure 20:
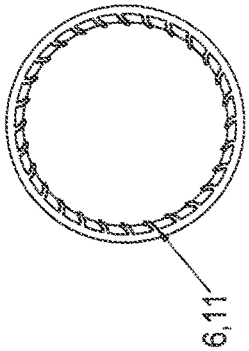
FIG. 20: Bottom view of a universal closure with flexible deformable arced vertical ribs 11.
Figure 17:
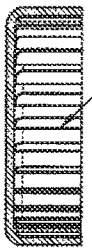
FIG. 17: Cross section view of a universal closure with flexible deformable angled vertical ribs 10.
Figure 18:
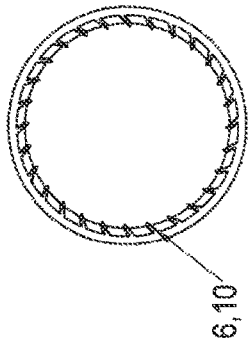
FIG. 18: Bottom view of a universal closure with flexible deformable angled vertical ribs 10.
Figure 15:
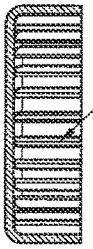
FIG. 15: Cross section view of a universal closure with flexible deformable vertical ribs 9.
Figure 16:
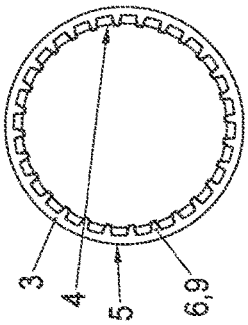
FIG. 16: Bottom view of a universal closure with flexible deformable vertical ribs 9.

As illustrated in FIGS. 2, 3, and 11, in some embodiments, the universal closure comprises one or more thinning ribs 19 to add flexibility to the side walls 2 or skirt of the closure. Added flexibility in the skirt allows the closure to conform to larger container neck diameters and conform to oval shaped container neck diameters. The thinning ribs 19 may be axial, radial, angled, arced, various other shapes or geometries, or combinations thereof. The thinning ribs 19 comprise one or more areas of the side wall outer diameter 5 where the side wall material is thinned enough to provide flexural deformation of the closure skirt when interference with the spacer ribs is created during application to the threaded container neck 20.

Foil Seal

In yet other embodiments, the universal closure of the present invention comprises a distal foil seal to provide sterility to the inside of the closure skirt and underside of the closure proximal top. The foil seal spans across the outer most diameter of the closure.

Container Openings and Neck Finishes

The universal closure of this invention is designed to fit a variety of neck finishes, thread profiles and container openings sizes of various containers. The container may have a neck 20 or other suitable structure defining the container mouth or opening. The neck may have a circular cross-sectional configuration or some other configuration like an oval or other elliptical, angular cross-sectional shape The universal closure of the present invention may be configured to provide sealing engagement with container necks of varying dimension. In some embodiments, the universal closure of this invention is configured to provide sealing engagement with container necks having a diameter from about 10 mm to about 45 mm. The universal closure as described above may be used alone as a cap to provide sealing engagement with a container to keep contents of a container from spilling or contamination. In one embodiment, there is a universal closure device comprising a proximal top, distal annular edge, side walls having an inner diameter and outer diameter, and at least one flexible deformable protrusion depending from the inner diameter of the side walls. In some embodiments, the deformable depending protrusion is a one or more flexible deformable rings, helix or combination thereof. In some embodiments, the deformable depending protrusion comprises more than one axial protrusion, including vertical ribs, angled ribs, arced ribs or combinations thereof. In other embodiments, the deformable depending protrusion comprises more than one radial rib, including horizontal ribs, angled ribs, arced ribs or combinations thereof. In some embodiments, the universal closure of the present invention further comprises a plug seal, a spacing diameter, more than one spacer rib, more than one thread engagement lug, one or more thinning ribs to the outer diameter of the closure skirt, or combinations thereof.

In another embodiment, there is a universal closure device comprising a proximal top, distal annular edge, side walls having an inner and outer diameter, and a plug seal. In other embodiments, the universal closure of the present invention further comprises a spacing diameter, more than one spacer rib, more than one thread engagement lug, one or more thinning ribs to the outer diameter of the closure skirt, one or more deformable protrusions depending from the inner diameter of the side walls, or combinations thereof.

In another embodiment, there is a method of closing a container neck or opening comprising applying to the neck of a container in need of sealing closure a universal closure device comprising a proximal top, distal annular edge, peripheral side walls having an inner and outer diameter, and one or more deformable depending protrusions. In another embodiment, there is a method of closing a container neck or opening comprising applying to the neck of a container in need of sealing closure a universal closure device comprising a proximal top, distal annular edge, peripheral side walls having an inner and outer diameter, and a plug seal.

Universal Inverted Press Part Dispensing Closure

The universal closure as described above may be used in combination with a dispensing device to provide sealing engagement for supply of a dose of product into a receiving container or vessel. In another aspect the present invention relates to novel universal inverted press part dispensing closure devices (e.g., FIGS. 1A, 1B, 2, 11, 12, 24, 27, 29-32, 35, 36, 38, 42). The press part may be a convex dome 23 or frustum cone 24 that becomes inverted 25 when pressed or activated (FIGS. 37-40). The universal inverted press part dispensing closures of the present invention may be used to separately house, store or carry a dose or supply of a product or one or more ingredients to maintain freshness and integrity of the ingredients until dispensed into a separate receptacle, receiving vessel or container. When activated the universal inverted press part dispensing closures of the present invention deliver the dose to the receiving vessel and allows the end user to dispense the dose or supply of product without the removal of the universal dispensing closure from a bottle or container thereby eliminating spills and contamination. The combined contents of the receiving vessel can be dispensed for consumption by removing the universal dispensing closure from the receiving vessel.

In some embodiments the universal inverted dome dispensing closure comprises a housing 26 and an attachment means 27 for attaching the universal inverted press part dispensing closure to a receiving vessel. In other embodiments the universal inverted dome dispensing closure comprises a housing 26, an attachment means 27 for attaching the universal inverted press part dispensing closure to a receiving vessel, and a receiving vessel 66.

Housing

Figure 1A:
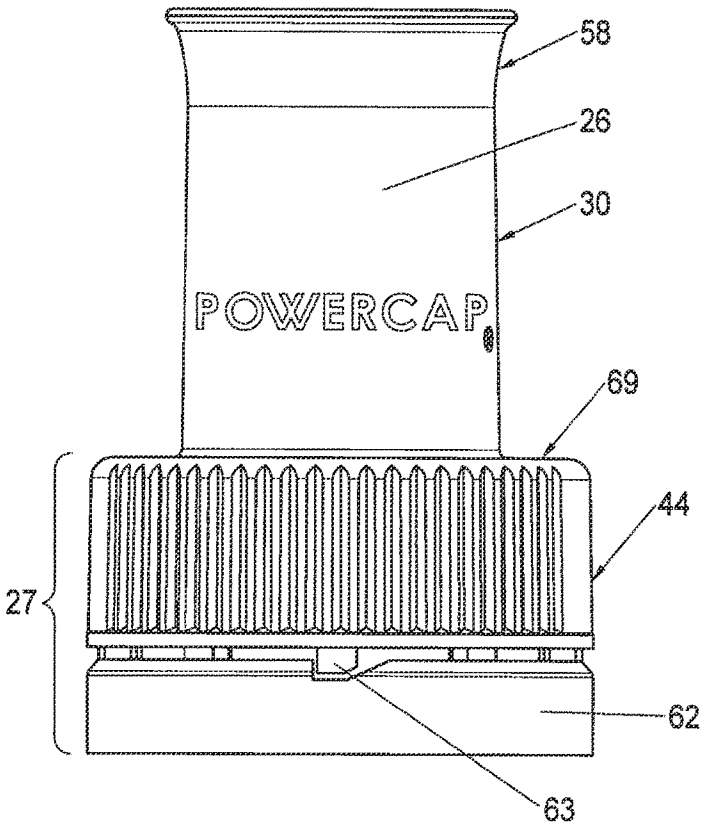
FIG. 1A: Side view of one embodiment of a fully assembled universal closure.
Figure 1B:
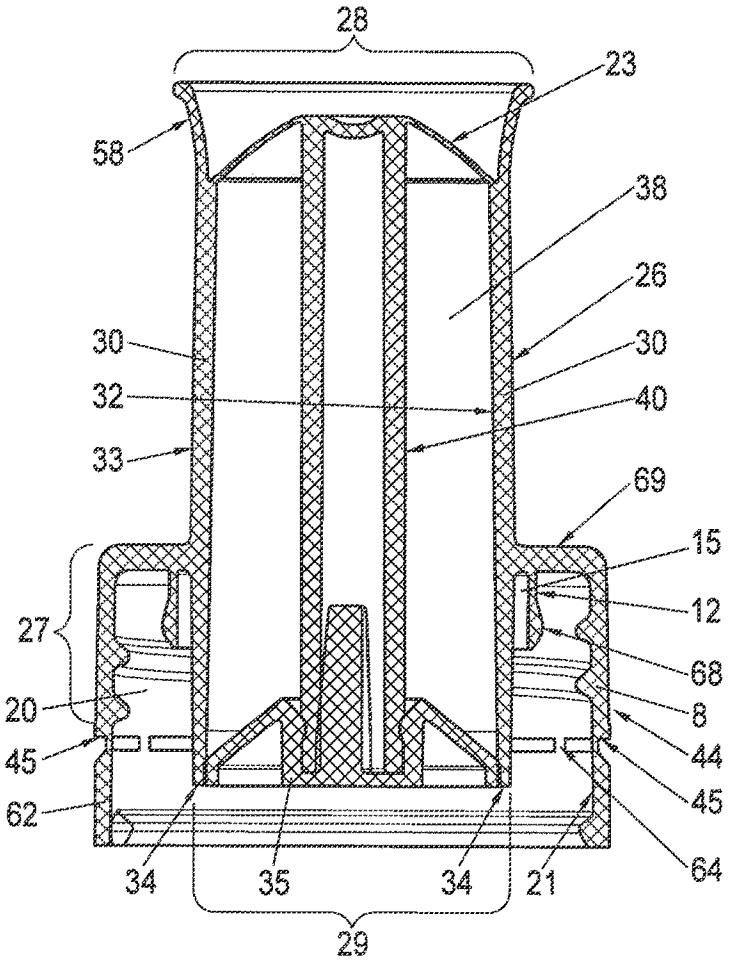
FIG. 1B: Cross section view of one embodiment of a fully assembled universal closure in the non-actuated state with standing radial rim 58.
Figure 29:
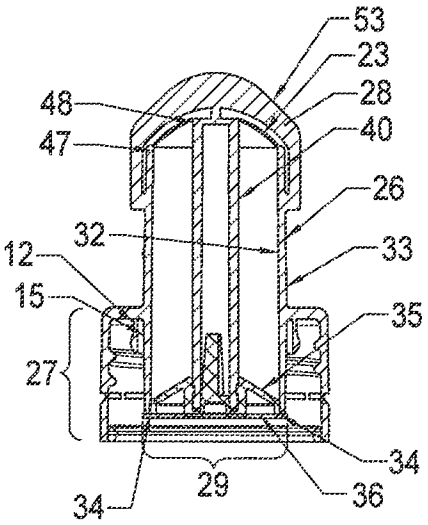
FIG. 29: Cross section assembly view of a tamper evident dosing closure with fold away truss 53 feature having radial hinges at the septum 48 and tube 47.

The housing 26 of the universal inverted dome dispensing disclosure has a proximal top end 28, a distal base end 29, side walls 30 and an internal volume 31 (FIGS. 1A, 1B, 29). In one embodiment the side walls of the housing 26 are curved to give the housing a tubular shape. The housing 26 is also referred to herein as the tube or housing tube. The side walls 30 have an inner diameter 32 and outer diameter 33. In one embodiment, each of the inner diameter 32 of the side walls 30 and the outer diameter 33 of the side walls 30 are substantially the same along their respective length from the proximal end 28 to the distal end 29 of the housing 26. In other embodiments, there are more than one of each of the inner diameter 32 and outer 33 diameter of the side walls along the length of the side walls 30 from the proximal end 28 to the distal end 29 of the housing 26. The side walls 30 comprise a distal annular edge 34. The tubular shape of the housing may be conical including any tapered tubular form or cylindrical including an elliptic cylinder shape, parabolic cylinder shape, hyperbolic cylinder shape, circular cylinder shape and generalized cylinder (in which the cross-section may be any curve) shape. In another embodiment the side walls of the housing are flat having three or more side walls forming an angular tube shape. The angular tube shape of the housing includes a triangular shaped tube, square shaped tube, rectangular shaped tube, polygon shaped tube. The proximal top 28 of the housing comprises a press part 23, 24 described in greater detail below. The distal base 29 of the housing comprises an end cap 35 and/or end plate seal 36 (FIG. 29) or septum end attachment 37 and end plate seal 36 (FIG. 27) as described in greater detail below. In some embodiments the internal volume 31 of the housing is predetermined for dosing and supplying methods.

Figure 27:
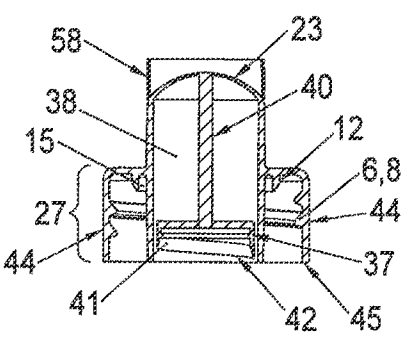
FIG. 27: Cross section view of a universal inverted dome dispensing closure with a tear away protective means surround the dome 58, identifies the dose chamber 38, the deck of the radial closure skirt 69, a threaded portion of the closure radial skirt 8, and illustrates a septum end attachment 37, and one or more radial beads 41.
Figure 25:
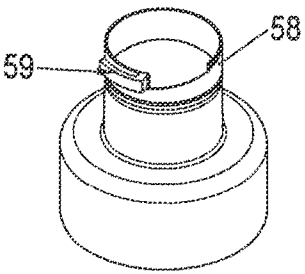
FIG. 25: Perspective view of a universal inverted dome dispensing closure with a removable standing radial rim 58 with a tear-away pull tab 59.
Figure 40:
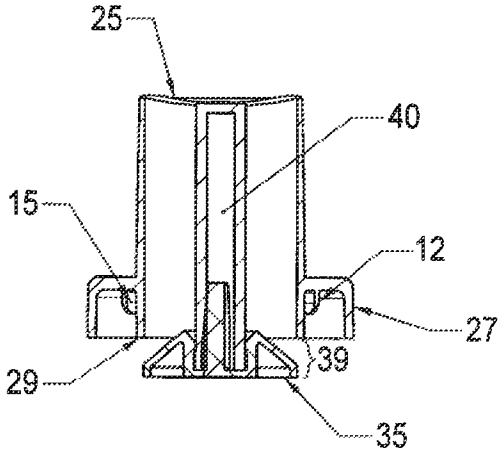
FIG. 40: Cross section view of a universal inverted dome dispensing closure in the activated position with the dome in the inverted concave configuration 25 and the end cap 35 in down position below the distal base of the housing 29.
Figure 39:
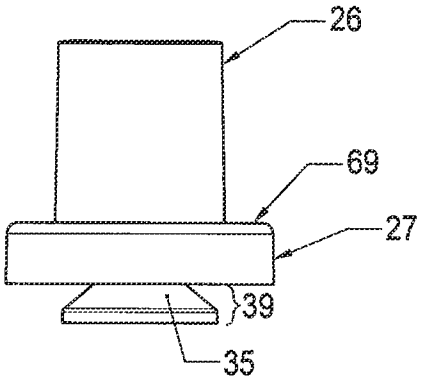
FIG. 39: Side view of a universal inverted dome dispensing closure in the activated position with the end cap 35 in the down position below the distal base of the housing.

As shown in FIGS. 1B and 27, the internal volume 31 of the housing comprises an internal hollow dose chamber 38. The hollow dose chamber is used to house one or more ingredients, formulations or products. The distal base 29 of the housing further comprises a dispensing port 39 when the closure device is activated. Referring to FIG. 40, upon actuation, there is provided a spaced opening 39 at the distal base 29 of the housing allowing one or more ingredients, formulations or product to exit the dose chamber and be dispensed.

Ingredients, Formulations or Products

The type and form of one or more ingredients, formulations or products 65 stored in the dose chamber 38 is unlimited. In some embodiments there is a single ingredient, formulation or product and in other embodiments there is a combination of ingredients, formulations and/or products. Non-limiting exemplary forms of ingredients, formulations or products include powders, dehydrated constituents, liquids, liquid concentrate and suspensions. Non-limiting examples of the types of ingredients, formulations or products that can be stored and dispensed from the universal dispensing closure include dietary supplements (e.g., fiber and vitamins), sport nutrition ingredients (e.g., amino acids, fat burning agents, muscle builders), diet nutrition ingredients (e.g., appetite suppressants, fat burning agents, ingredients causing a feeling satiety), ingredients with anti-aging benefits, immune supporting ingredients (e.g., prebiotics, probiotics), energy boosting agents, stimulants, anti-oxidants, anti-hangover formulations.

The ingredients, formulations and products capable of being stored and dispensed from the universal dispensing closure device can also include medicaments, biologics, microorganisms, nutraceuticals, drugs, prodrugs and pharmaceuticals. It is desirable to formulate a point of use form of delivering medicine that avoids the need to swallow hard tablets, capsules, avoids bad taste associated with more traditional forms of medicines and maintains the product integrity.

Any of the one or more ingredients, formulations or products stored and dispensed by the universal dispensing closure device of the present invention may be stored independently or in combination with other ingredients, flavoring, sweetening, acidulants, excipients, preservatives and/or coloring agents.

Other applications of the universal dispensing device of the present invention are described below.

User-Actuated Dispensing Means

Figure 24:
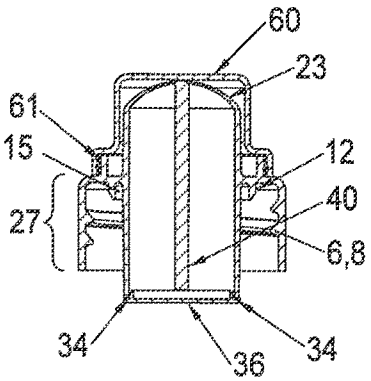
FIG. 24: Cross section view of a universal inverted dome dispensing closure in assembly identifying the dome 23, septum 40, end plate seal 36 position and a threaded portion 6, 8 of the closure radial skirt 27 and illustrating the protective overcap 60 in a closed position and a hinge attachment area 61 for the protective overcap.
Figure 22:
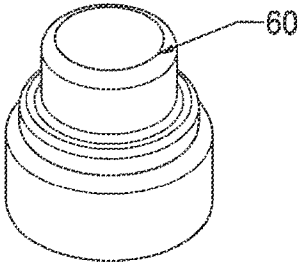
FIG. 22: Perspective view of a universal inverted dome dispensing closure with protective overcap 60 applied.
Figure 23:
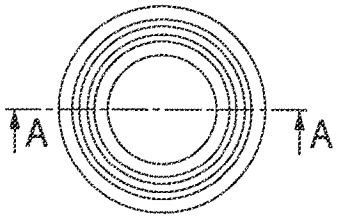
FIG. 23: Top view of a universal inverted dome dispensing closure with the protective overcap 60 applied.
Figure 32:
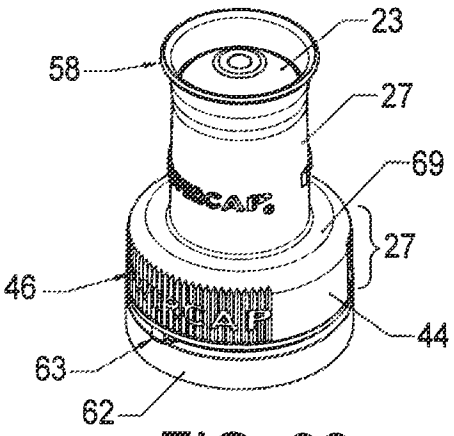
FIG. 32: Perspective view of tamper evident dosing closure with a standing radial rim 58.
Figure 31:
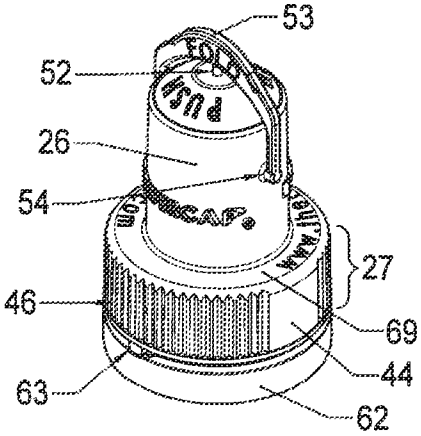
FIG. 31: Perspective view of tamper evident dosing closure with fold away truss or tab 53 feature.
Figure 30:
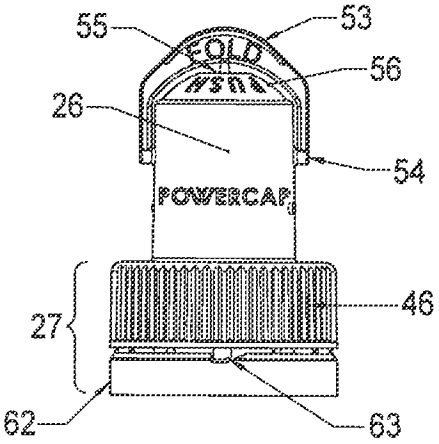
FIG. 30: Front view of the tamper evident dosing closure with a fold away truss or tab 53 feature showing the break-away attachment 55 to, and a hinge portion for 54, the fold away truss or tab.
Figure 28:
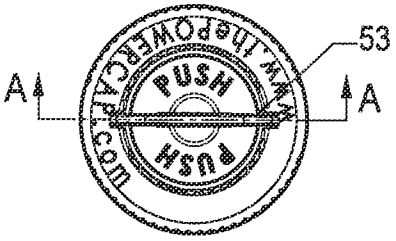
FIG. 28: Top view of a tamper evident dosing closure with a fold away truss or tab 53 feature.
Figure 43:
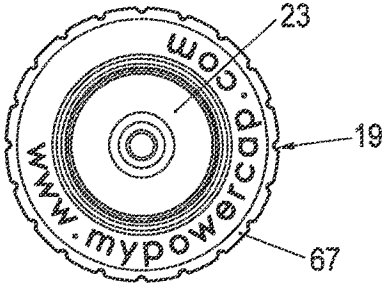
FIG. 43: Top view of an inverted frustum cone 24 dispensing closure.
Figure 42:
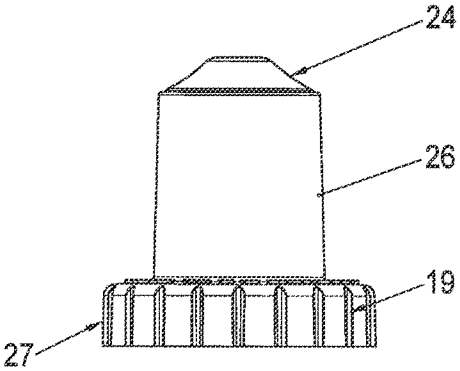
FIG. 42: Side view of an inverted frustum cone 24 dispensing closure.

The housing 26 further comprises a user-actuated means for dispensing the one or more ingredients, formulations or products. In one embodiment the dispensing means comprises a press part 23 or 24, a septum 40 and an end cap 35 (FIGS. 1B, 29, 35, 39-41). In another embodiment, the dispensing means further comprises an end plate seal 36 (FIG. 24). In another embodiment the dispensing means comprises a press part 23, 24, a septum 40, a septum end attachment 37 and end plate seal 36 (FIG. 27). In some embodiments the dispensing means comprises a press part having a convex dome shape 23. In some embodiments the press part is a frustum cone shape 24 (FIGS. 42, 43). The dispensing means is intended to be actuated at the point of use by an end user. The end user activates dispension by applying a force to the convex press part, 23, 24. The end user applies a pressing force to the convex dome 23 or frustum cone 24 causing inversion into a concave configuration 25 (FIG. 37-40). In one embodiment, movement of the press part into a concave configuration 25 applies a force on to the septum 40 causing the septum to move in a distal direction and press upon the end plate seal 36, end cap 35 or septum end attachment 37. In one embodiment, the force of the septum 40 pressing upon the end plate seal 36 causes the end plate seal 36 to shear, break or fracture. In another embodiment, the force of the septum 40 pressing upon the end cap 35 causes the end cap 35 to shear, break or fracture the end plate seal 36 and move beyond the distal base of the housing 29. In another embodiment, the force of the septum 40 pressing upon the septum end attachment 37 causes the septum end attachment 37 to shear, break or fracture the end plate seal 36 and hold the flexible end plate seal 36 within the radial beads 41 positioned to the inside of the cupped end of the septum end attachment 42. In all embodiments, there is created a spaced opening 39 in the distal end of the housing 29 allowing one or more ingredients, formulations or products to exit the dose chamber and be dispensed.

Press Part

The press part is located at the proximal top end 28 of the housing 26 and is the component actuated by the end user. In one embodiment, the press part is a convex dome 23, as shown in FIGS. 2, 11, 24, 27, and 29-36. In one embodiment the press part is a frustum cone 24 as shown in FIGS. 42 and 43. The press part is made of a thin uniform wall of material that can be readily deformed into an inverted concave configuration 25 when sufficient force is applied to it. Applying a force against the press part to cause a concave configuration initiates the dispensing. In some embodiments the end user actuates the dispensing by applying a force against the press part causing the press part to depress into an inverted concave configuration.

In some embodiments the convex dome press part 23 is configured with a plurality of radial hinge members 47 and 48 that are spaced apart throughout the arc of the dome (FIG. 29). In some embodiments there are radial hinge elements placed at the upper radial edge of the tube 47, at the upper radial edge of the septum 48 and combinations thereof. The radial hinges 47 and 48 are configured in a manner to allow the convex dome 23 to flex to a maximum inverted position. When the convex dome is molded in anything but white colored material, the flexing portion of the dome creates a crease at the areas where the dome bends. The whitening is a function of the material or resin used to mold the press part. The crease is also influenced by the design of fillet radii in that flexing area. One skilled in the art will know the specific geometry needed to make sure these areas bend or flex without shearing as the material is stressed beyond its natural elastic limits at the outer and inner portions of the dome.

In some embodiments the underside of the convex dome 23 has supporting axial ribs, radial ribs or combinations thereof. The supporting dome ribs provide actuation feel for the end user. In other embodiments, the frustum cone 24 press part, having a general convex shape and capable of being pressed into a concave configuration, is configured with radial hinges, axial ribs, radial ribs or combinations thereof.

Septum

At the apex of the press part 23, 24 there is a depending septum 40 extending towards the distal base of the housing 29 as exemplified in FIGS. 24, 27, 29, 35 and 36. In some embodiments the septum 40 is integrally molded to the underside of the press part 23, 24. In some other embodiments the septum 40 is interferingly engaged with the underside of the press part 23, 24. The septum 40 is actuated by the inverted press part 23 or 24 pressing on its proximal end and moving it toward the distal base of the housing 29. In some embodiments, the distal end of the septum is configured to receive an end cap 35 in mating engagement. In other embodiments, the distal end of the septum 40 is attached to a septum end attachment 37. The septum 40 is configured to be in axial alignment with the housing 26 in a non-activated state and maintains axial alignment during actuation of the dispensing means and accepting of the end cap.

The septum 40 is substantially rigid and not intended to bend or flex to a deformable position. The rigidity of the septum 40 aids assembly so that it can readily accept the end cap 35 as there is interfering engagement in between the septum 40 and the end cap 35. The end cap 35 is intended to remain engaged in the septum 40 and not be readily removed from the septum 40. As the press part is inverted the septum 40 forces the end cap 35 in a downward direction beyond the distal base 29 of the dose chamber and housing. The strength of the septum 40 needs to be structurally sound enough to forcibly remove the end cap 35 from the product chamber where there is diametrical interference.

End Cap

The end cap 35 is located toward the distal base of the housing 26 and is mating engagement with the distal end of the septum 40 as exemplified in FIGS. 1B, 29 and 35. In some embodiments the end cap 35 is configured to receive the distal end of the septum 40 in a proximally situated recess 50 (FIG. 47) to maintain axial alignment within the housing 26. In other embodiments the septum 40 is configured to receive the proximal end of the end cap 35. The end cap 35 is in interfering engagement with the inside diameter 32 of the side walls 30 of the housing 26 sufficient to provide sealing integrity alone and maintain the one or more ingredients, formulations or products in the dose chamber of the housing tube. In some embodiments, the end cap 35 is comprised of propylene and ethylene materials. In some embodiments the end cap 35 and internal side walls of the housing tube 26 are made of highly polished mating surfaces. These highly polished faces when in intimate contact provide superior seal integrity against moisture and maintain product integrity. Such polishing methods are known to one of skill in the art.

In one embodiment, the end cap 35 can be configured to include a liner in between the distal end of the septum 40 and the proximal surface of the end cap recess 50 in mating engagement with the distal end of the septum 40 but for the liner to provide sealing interface and added removal resistance. A small foil disc with materials coated on the outside is cut and placed into the bottom of the proximal recess of the end cap 50 formed to accept the septum 40. The liner welds to both portions, the end cap 35 and the septum 40 at the proximal end cap recess 50 using an RF (radio frequency) sealing process common in the foil liner applications. Welding with this type of liner has several advantages (i) the strength of the weld is very strong such that the end cap 35 cannot be readily separated from the septum 40; (ii) the weld is more targeted (than spin welding, sonic welding and heat stake welding), thus avoiding adhering other nearby portions of the device like the outer portions of the end cap to the housing tube.

Figure 47:
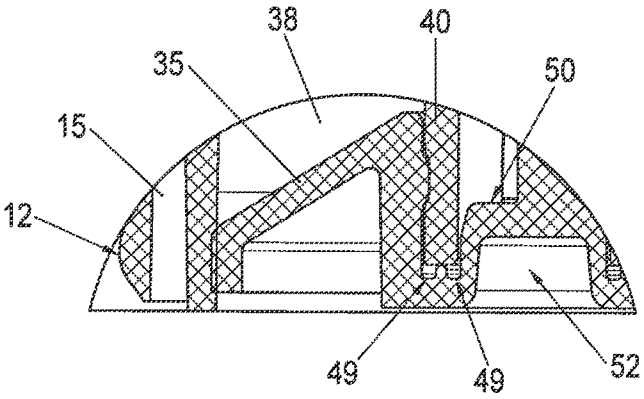
FIG. 47: Close-up view of universal dispensing closure device showing distal end cap recess 52, center flash spacing 49 and proximal position of end cap in relation to distal end of housing.
Figure 46:
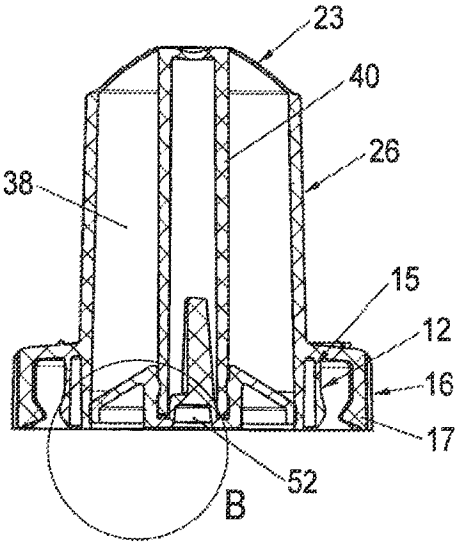
FIG. 46: Cross section view of universal dispensing closure device showing distal end cap recess 52, center flash spacing 49 and proximal position of end cap in relation to distal end of housing.

In another embodiment, the end cap 35 is configured to have a distal recess 52 as illustrated in FIGS. 46 and 47. The distal end cap recess 52 provides a space for any residual plastic from the molding process to remain out of the way and alleviate risk of the residual plastic puncturing the end plate seal 36 (described below) if provided.

In another embodiment, the proximal end cap recess 50 comprises two additional distally located spaces 49 (FIGS. 46 and 47). These spaces are provided to receive center flash resulting from the molding process of the universal dispensing closure. The center flash spacing 49 retains the center flash so to avoid interference with, the mechanics of the universal dispensing closure, and end cap placement helping to maintain proper axial alignment.

In some embodiments, the septum 40 and end cap 35 are configured in dimension such that the end cap 35 is flush with the distal end of the housing 29 in the non-actuated state. In other embodiments, the septum 40 and end cap 35 are configured in dimension such that the end cap 35 sits proximal to the distal end of housing 29 in the non-actuated state (FIGS. 46 and 47). The later embodiment is useful for universal dispensing devices comprising an end plate seal 36 (described below). The end cap 35 in a non-flush more proximal position to the distal end of the housing 29 in the non-actuated state improves the radial seal of the end plate seal 36 to the distal annular edge 34 of the housing tube 26. It ensures that the end plate seal 36 will attach properly to the radial annular edge 34 of the housing tube 26 and avoids end plate seal 36 contact with the end cap 35 itself and avoids sealing the end cap 35 to the housing 26. In other embodiments, the end cap 35 together with the housing tube 26 protrudes beyond the distal annular edge 45 of the closure skirt 27.

End Plate Seal

In some embodiments an end plate seal 36 is used to provide a protective seal at the distal annular edge 34 of the housing tube 26. The end plate 36 extends across the distal base end of the housing tube 29 as exemplified in FIG. 29. The end plate is sealed at the distal annular edge 34 of the housing 26. The end plate seal 36 may be made from a variety material that are thin and frangible in nature to fracture when the press part 23, 24 is inverted to a concave shape 25 causing the engaged septum 40 to apply a force against the end plate shearing and fracturing the end plate. In another embodiment, the septum engaging the end cap 35 applies force against the end plate seal causing the end plate to shear and fracture. In some embodiments a foil liner is applied at the distal base of the end cap and distal base of the housing tube to seal the interior of the housing tube. The closure created by the end plate seal is used to add to product efficacy and provide tamper evidence if prematurely breached.

In other embodiments the foil end plate seal 36 is supported by plastic across the entire face of the foil to provide sufficient mechanical support to pass common shipping, filing and drop tests and to maintain product integrity. Use of a supporting plastic also allows for a majority of the foil to by intimately attached to both the polypropylene (PP) and high density polyethylene (HDPE) polymers used to mold the universal inverted dome dispensing closure device components thereby reducing the amount of foil particulates falling into the receiving vessel upon dispension. The plastic lining also reinforces the seal for purposes of ingredient freshness and product integrity.

Septum End Attachment

In some embodiments the universal inverted press part dispensing closure further comprises a septum end attachment 37 as exemplified in FIG. 27. This separate attachment is used to capture a foil type of an end plate seal 36. The septum end attachment 37 is configured in a manner to apply uneven pressure on the end plate 36 to reduce the force required to fracture or open the end plate 36. The septum end attachment 37 is generally reduced in diameter from the dose chamber 38 to allow free movement of the septum 40 and press part inversion 25. The septum end attachment 37 is configured to include one or more radial beads 41 and is largely cupped in configuration. Once the press part is inverted the septum end attachment acts against the end plate 36 in sufficient force to break-away the end plate seal. The end plate seal 36 being flexible enough to accept the cup shaped septum end attachment and hold the flexible seal within the radial beads positioned to the inside of the cupped end of the septum end attachment.

Universal Closure Radial Skirt

The housing 26 is attached to a universal closure radial skirt 27. The universal closure radial skirt 27 serves to attach the universal inverted dome dispensing closure device to a receiving vessel 66 capable of receiving the one or more ingredients, formulations or ingredients dispensed from the housing. Referring to FIGS. 1A and 1B, the closure radial skirt 27 has a proximal upper deck or top 69, peripheral side walls 44, and a distal annular edge 45. The universal closure radial skirt 27 comprises the features and functionality as described above for the universal closure. In some embodiments, the universal closure radial skirt 27 has a greater diameter than the housing 26. In other embodiments, the universal closure radial skirt 27 has substantially the same outer diameter as the housing tube. As shown in FIGS. 30-32 and 34, in some embodiments there are longitudinal finger recess elements 46 on the outer side walls 44 of the closure radial skirt for better grasping by the end user.

The position of the housing 26 in relation to the closure skirt 27 may vary. In some embodiments, the distal end of the housing 29 sits beyond the distal annular edge 45 of the closure skirt (e.g., FIG. 1B). In other embodiments, the distal end of the housing 29 sits proximal to the distal annular edge 45 of the closure skirt. In yet other embodiments, the distal end of the housing 29 sits flush with the distal annular edge 45 of the closure skirt (e.g., FIG. 12).

In one embodiment of the present invention there is a universal dispensing closure capable of providing sealing engagement with the opening of a receiving vessel for dispension of a product, admixture of products, and retaining the mixture of products without spilling or contamination comprising a housing having a dose chamber and a user-actuated means for dispensing one or more ingredients, formulations or products; and a closure radial skirt having a proximal top, distal annular edge, side walls and one or more deformable depending radial, axial, angled, arced protrusions of varying dimensions or combinations thereof. In another embodiment the universal dispensing closure comprises a housing having a dose chamber and a user-actuated means for dispensing one or more ingredients, formulations or products; and a closure radial skirt comprising a proximal top, side walls and a plug seal. Other embodiments further comprise a spacing diameter, more than one spacer rib, more than one thread engagement lug, one or more thinning ribs or combinations thereof.

Another aspect of the invention provides a universal dispensing closure device capable of housing, storing and carrying a dose or supply of product until a desired point of use as determined by the end user.

Another aspect of the invention provides a universal closure device capable of dispensing at the point of use one or more ingredients, formulations or products. The universal dispensing closure devices of the present invention in some aspects are attached to a receptacle, container or vessel capable of receiving the one or more ingredients, formulations or products dispensed from the closure apparatus. The universal dispensing closure devices of the invention in some embodiments comprise a press part, like a convex dome or a frustum cone, that when pressed it becomes inverted forming a concave configuration thereby activating dispension of one or more ingredients, formulations, or products.

In one embodiment of the invention the universal closure is a universal inverted press part dispensing closure comprising a housing having a press part, a septum, and an end plate seal; a receiving vessel attached to the inverted dome dispensing closure; and a user-actuated means for dispensing from said universal inverted press part dispensing closure one or more ingredients, formulations or products. In some embodiments, the housing of the universal inverted press part dispensing closure further comprises an end cap or a septum end attachment. In some embodiments, the press part is a frustum cone capable of being pressed into a concave configuration. In some embodiments, the user actuated means for dispensing comprises application of a pressing force against the press part to cause the convex press part to be in a concave configuration.

In another embodiment there is a universal dispensing closure device comprising (a) a housing wherein the housing comprises a press part at the proximal top end, an end plate seal at the distal base, a septum in axial alignment within the housing depending from the apex of the press part toward the base of the housing; and (b) a means for attaching the universal dispensing closure device to a receiving vessel comprising a closure radial skirt attached to the outer diameter of the housing, having a greater outer diameter than the housing, having depending radial protrusions of varying dimensions, and capable of attaching to a receiving vessel for dispensing one or more ingredients, formulations or products therein.

In another embodiment there is a universal dispensing closure device comprising (a) a housing wherein the housing comprises a press part at the proximal top end, an end plate seal at the distal base, a septum in axial alignment within the housing depending from the apex of the press part toward the base of the housing, an end cap in mating engagement with the base of the septum; and (b) a means for attaching the universal dispensing closure device to a receiving vessel comprising a closure radial skirt attached to the outer diameter of the housing, having one or more deformable depending protrusions of varying dimensions, and capable of attaching to a receiving vessel for dispensing one or more ingredients, formulations or products therein.

In another embodiment there is a universal dispensing closure device comprising (a) a housing; and (b) an attachment means for attaching, removing and reattaching the universal dispensing closure device to a receiving vessel; (c) the housing comprises a press part at the proximal top end, an end cap at the distal base, a septum in axial alignment within the housing depending from the apex of the press part toward the base of the housing; and (d) the attachment means comprising a closure radial skirt attached to the outer diameter of the housing, having one or more deformable depending protrusions of varying dimensions, and capable of attaching to a receiving vessel for dispensing one or more ingredients, formulations or products therein. In some embodiments the housing further comprises ingredients contained therein a dose chamber. In some embodiments the housing further comprises an end plate seal at the distal base of the housing.

In another embodiment there is a universal inverted press part storage and dispensing closure device comprising: (a) a housing having a dose chamber and a user-actuated means for dispensing one or more ingredients, formulations or products; and (b) an attachment means for attaching the device to a receiving vessel comprising a closure radial skirt attached to outer diameter of the housing in axial alignment with the housing, having a greater outer diameter then the housing, having depending radial protrusions of varying dimensions, and capable of attaching to a receiving vessel for dispensing the one or more ingredients, formulations or products therein. In some embodiments the user-actuated means for dispensing comprises a convex dome, a septum, an end cap. In some embodiments the user-actuated means for dispensing comprises a frustum cone, a septum, and an end cap. In other embodiments the user-actuated means for dispensing further comprises an end plate seal. In some embodiments the user-actuated means for dispensing comprises a convex dome, a septum, septum end attachment and end plate seal. In some embodiments the user-actuated means for dispensing comprises a frustum cone, a septum, septum end attachment and end plate seal.

Receiving Vessel

The universal closure devices of the present invention are configured to attach to and provide sealing engagement to a variety of receiving vessels. The receiving vessel may be any container, receptacle, vessel of varying size and shape capable of being attached to the universal dispensing closure devices of the present application. It may be constructed from glass, plastic or other similar material. In some embodiments the receiving vessel has a threaded neck for attachment thereto. In some embodiments the receiving vessel is attached to a universal dispensing closure of the present invention by a manufacturer. In other embodiments the receiving vessel is attached to a universal dispensing closure device of the present invention at the point of use by an end user. In some embodiments the receiving vessel has a pliable seal at the land of the vessel opening that can be removed by an end user at point of use before attachment. The pliable seal at the land of the vessel opening is used to maintain product integrity of the receiving vessel. In other embodiments the receiving vessel has a removable screw cap or such other removable top that once removed it is capable of attaching to the universal dispensing closure devices.

Non-limiting exemplary receiving vessels include bottles, other beverage containers, cartons, canteens, stand-up pouches, cans, flasks, glass bottles, and the like.

The type and form of one or more ingredients, formulations or products of the receiving vessel is unlimited. Non-limiting exemplary forms of ingredients of the receiving vessel includes beverages, drinks, infusions, liquids, shots, suspensions, syrups and swills. Non-limiting examples of the one or more ingredients, formulations or products of the receiving vessel include water, sports drinks, meal replacement beverages, diet beverages, energy drinks. The receiving vessel may also contain excipients, acidulants, sweeteners, flavoring agents and coloring agents for easier consumption by the end-user of a medicament, drug or pharmaceutical dispensed therein.

Materials

The materials of the universal inverted dome dispensing closure device are primarily comprised of propylene and ethylene materials or combinations thereof. In some embodiments the material is polypropylene (PP) and/or polyethylene (PE) materials. In some embodiments the material is a high density polyethylene (HDPE). Alternate materials of flexible nature can also be employed like thermoplastic elastomers and others of a lower modulus sufficient to provide flexibility. In another embodiment the universal dispensing closure device is made with materials that block UV light.

Tamper Evident and Protective Components

It is another aspect of the invention to provide a point of use universal dispensing closure device as described above that indicates to the end user whether inadvertent dispension or tampering with the product has occurred and that protects from accidental, inadvertent or premature dispension.

Inverted Dome Configuration

In some embodiments, the convex dome 23 of the universal dispensing devices of the present invention may itself be configured to indicate tampering. In one tamper evident embodiment, the convex dome is designed in such a manner as to not be readily re-inverted, or moved from a concaved activated position back to a convex aimed and ready for use position. The dome once activated, does not return to the pre-flexed position on its own accord. The radial hinges 47, 48 act to maintain the inverted concave position of the activated dome. Once inverted, the dome then in a concave configuration 25 resides below the proximal upper edge of the housing tube sufficient to not allow re-inversion. Inversion of the dome prior to the point of use is indicative of tampering and/or premature dispension.

Fold Away Tab

As seen in FIGS. 28-31, in some embodiments there is a fold away tab or truss 53 added to the convex dome to protect against inadvertent activation and dispension. The fold away attachment can be configured to extend from the housing tube to which the dome is attached or from the deck 69 of the closure radial skirt 27. The truss 53 has an outboard hinged attachment 54 to the housing tube 26 or the deck of the closure radial skirt 69. In some embodiments the truss 53 also has a break-away attachment 55 centered to the dome and truss, and between the proximal end of the dome and the distal underside of the truss. A broken break-away attachment 55 such that it no longer connects the underside of the truss to the outer diameter of the convex dome indicates that tampering has occurred. In some embodiments, there is a space 56 between the truss 53 configuration and housing tube 26 and the convex dome 23 for ease of customer use. The truss 53 and break-away attachment 55 are also used to prevent the convex dome 23 from premature inversion in the event a vacuum is formed on the end of the closure inside a vessel.

Figure 37:
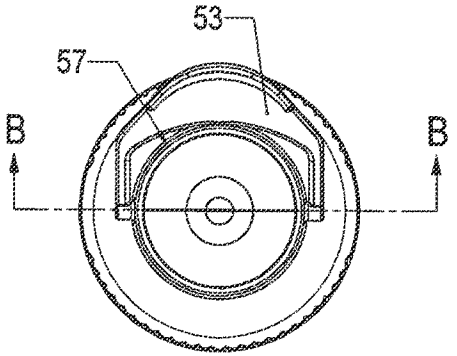
FIG. 37: Top view of a flexible dome in the inverted concave position with fold away truss 53 in the folded position.
Figure 38:
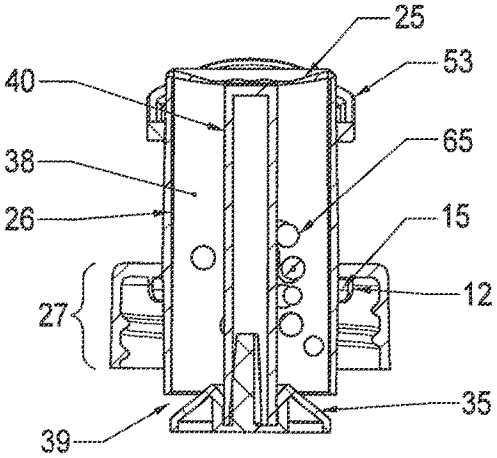
FIG. 38: Cross section view of a universal inverted dome dispensing closure in an open or activated position for dispensing ingredients.
Figure 41:
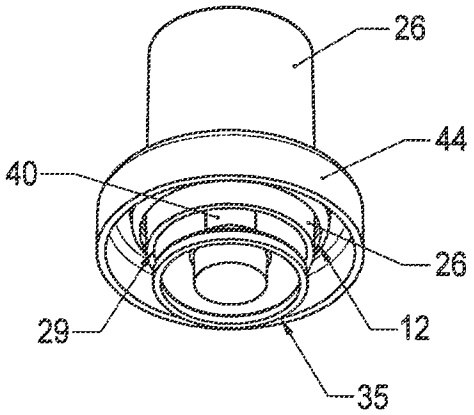
FIG. 41: Perspective view of the underside an inverted dome dispensing device (with threads removed from closure radial skirt) in the activated position with end cap 35 in down position below the distal base of the housing 29.

The universal inverted dome dispensing closure is activated by pressing on the truss 53 in a manner to fold it away from the top of the convex dome 23. The folding motion shears the break-away attachment 55 and is hingedly pivoted 54 beyond the outer edge of the dome toward the radial edge 57 of the housing tube (FIGS. 37 and 38). The truss 53 is configured to have interfering engagement with the radial edge of the housing tube 57 to prevent the truss from moving back over the dome.

A fold away truss or tab 53 as described herein may also be employed with a frustum cone 24 press part to protect from inadvertent activation and dispension of product and for use as an indicator of tampering.

Radial Rim

As seen in FIGS. 25-27 and 32, in some embodiments, the convex dome can be configured to have a surrounding structure around the dome, a standing radial rim 58, to prevent inadvertent actuation. In some embodiments the standing radial rim 58 may be configured with one or more ports or openings to allow easier user access or to drain water after washing. In another embodiment, the standing radial rim is removable. A removable standing radial rim further comprises a pull tab 59 to remove the rim from the housing to provide easier access to the convex dome for actuation at point of use. Removal of the radial rim before actuation by the end user is indicative of tampering. A radial rim as disclosed herein may also be employed to protect a frustum cone shaped press part from inadvertent activation and dispension of product and as an indicator of tampering.

Protective Overcap

As seen in FIGS. 22-24, 33-36, some embodiments of the universal inverted press part dispensing closure further comprise a removable protective overcap 60 to protect against inadvertent inversion of the convex dome or the frustum cone into a concaved position. The protective overcap 60 surrounds the press part leaving a space between the cap and the press part such that a reasonable force against the protective overcap does not invert the dome. In some embodiments there is a hinge 61 connecting the protective overcap to the inverted dome disclosure device allowing removal and reattachment of the cap. The hinge 61 may connect the protective overcap to the radial closure skirt or the outer diameter of the housing. In other embodiments once the protective overcap is removed it cannot be reattached. A pull tab may be used to remove the protective overcap. The pull tab if actuated can be indicative of tampering if removed prior to the point of use.

Tamper Evident Skirt

In some embodiments as shown in FIGS. 30-32, 34, the closure radial skirt has a frangible tamper evident (TB) skirt 62 removably attached to its distal annular edge 45 that interferingly engages with the neck of an attached receiving vessel to prevent removal of the inverted press part dispensing closure. In one embodiment, there is a pull tab 63 that when pulled breaks the TE skirt 62 away from its engagement with the closure radial skirt. In another embodiment, the TE skirt 62 is attached by one or more break away tabs 64 (FIG. 34) such that application of a twisting motion of the closure radial skirt in a counter clock wise direction breaks the TE skirt 62 away. A TE skirt that is not in interfering engagement with the receiving vessel at point of use is indicative of tampering. The closure radial skirt can be used with or without the depending tamper evident skirt band.

Mechanism of Action

In some embodiment, the one or more ingredients, formulations or products stored inside the dose chamber 38 of the housing tube 26 are released by applying a force against the press part 23, 24. In some embodiments, the end user presses the press part. An embodiment of the mechanism of action is illustrated in FIGS. 38-41. The convex dome 23 is pressed downwardly or inwardly until it inverts and remains in a now concaved configuration 25. This action directly acts on the depending septum 40 which is attached to the end cap 35. The septum 40 moves vertically downward pressing the end cap 35 from its inactivated position within the diameter of the housing to its activated position below the distal end of the housing 29. This motion also causes the end cap to breach the end plate seal 36 lining allowing the one or more ingredients, formulations or products inside the dose chamber 38 of the housing tube a path way out of the tube. The pathway out of the tube is a spaced opening or port 39 for maximum dispension about the entire area of the distal base of the housing 29 except for the area of the distal base of the septum.

In another embodiment as illustrated in FIG. 24 (in the ready or inactivated form), the septum 40 acts directly on the end plate seal 36 in sufficient force to break-away the end plate seal 36.

In another embodiment as illustrated in FIG. 27 (in the ready or inactivated form), the septum 40 acts directly on a septum end attachment 37. In turn the septum end attachment 37 acts against the end plate seal 36 in sufficient force to break-away the end plate seal 36. The one or more radial beads 41 in the cupped end of the septum end attachment retain the broken end plate seal.

In some embodiments, the user-actuated dispensing means of the present invention maximizes the size of the dispensing port 39 from which one or more ingredients, formulations or products are dispensed. The disclosed user-actuated dispensing means provide a spaced opening 39 at the distal end of the housing 29 allowing one or more ingredients, formulations or products to exit the dose chamber 38 and be dispensed. This created spaced opening is the dispensing port. The one or more ingredients, formulations or products 65 are able to flow directly from the dose chamber 38 of the housing into the receiving vessel. In some embodiments, the dispensing port 39 is substantially the same in diameter as the housing. In some embodiments, the dispensing port 39 has an area substantially the area of the distal base of the housing excluding the area of the distal base of the septum 40.

The universal inverted press part dispensing closure device is a one-piece single action delivery method to supply a dose or supply of product into a vessel to which it is attached. The design is intuitive to use and entails a one-touch easy operation by an end user. There is no twisting motion needed for dispensing and no long sleeves or other interfering extensions in the housing tube thereby avoiding or alleviating product interference with the mode of operation for dispensing.

The universal dispensing closure of this invention minimizes components and materials which simplifies assembly. It is constructed with fewer parts than other closures on the market. Because there are fewer components to manufacture and the components are manufactured to minimize the amount of materials used, the dispensing closures of this invention use less material to improve manufacture-ability and reduce environmental impact. Fewer components of the present invention also simplify assembly and filing.

The dose chamber 38 is filled from the distal base of the housing 29 with the housing in an inverted position. In some embodiments, the distal base of the housing 29 is open or not yet sealed by an end cap 35, septum end attachment 37 and/or end plate seal 36. The open space at the distal end 39 of the housing tube provides a target for easily filling the dose chamber with automated and semi-automated filling equipment of various sophistications. The relatively large target allows for automated assembly to readily locate, index, fill and sense the proper fill has been achieved.

Methods of Dispensing A Dose

In another aspect of the invention there are methods of supplying or dispensing a dose or one or more ingredients, formulations or products comprising providing a universal dispensing closure device of the present invention, and dispensing the one or more ingredients, formulations or products therefrom. In some embodiments the dispensing disclosure device is provided attached to a receiving vessel. In other embodiments, attachment of the receiving vessel to a universal dispensing closure device is performed by an end user.

In one embodiment there is a method for supplying a dosage of one or more ingredients, formulations or products to another set of one or more ingredients, formulations or products for admixture comprising the steps of: (a) providing a universal inverted dome dispensing closure universal inverted dome dispensing closure having a housing, wherein the housing comprises a septum, a convex dome, and an end plate seal, and one or more ingredients, formulations or products stored within; (b) providing a receiving vessel having another set of one or more ingredients, formulations or products and capable of receiving the one or more ingredients, formulations or products from the inverted dome dispensing closure; (c) attaching the universal inverted dome dispensing closure to the receiving vessel; and (d) dispensing by a user actuate means from the universal inverted dome dispensing closure the one or more ingredients, formulations or products into the receiving vessel. In some embodiments the housing further comprises an end cap. In other embodiments the housing further comprises a septum end attachment. In some embodiments the universal inverted dome dispensing closure is attached by screwing it on to the receiving vessel. In other embodiments the universal dispensing device is pressed onto the neck of receiving container.

In another embodiment there is a method for supplying a dosage of a first set of one or more ingredients, formulations or products to a second set of one or more ingredients, formulations or products comprising the steps of: (a) providing a universal inverted press part dispensing closure attached to a receiving vessel wherein the universal inverted press part dispensing closure comprises a housing having a press part, a septum, an end plate seal, and a first set of one or more ingredients, formulations or products stored within; and (b) dispensing from the universal inverted press part dispensing closure by user-actuated means the first set one or more ingredients, formulations or products into the receiving vessel. In some embodiments the housing further comprises an end cap or a septum end attachment. In one embodiment the user-actuated means comprises applying a pressing force against the press part.

In another embodiment there is a method for supplying a dosage of a first component comprising one or more ingredients, formulations or products to a second component comprising another set of one or more ingredients, formulations or products comprising the steps of: (a) providing a universal inverted press part dispensing closure attached to a receiving vessel wherein the universal inverted press part dispensing closure comprises a housing comprising a user-actuated dispensing means and dose chamber having a first component stored within; and (b) dispensing from the universal inverted press part dispensing closure by user-actuated means the first component into the receiving vessel having a second component therein. In some embodiments the user-actuated dispensing means comprises a press part and a septum. In some embodiments the user-actuated dispensing means comprises a press part, a septum and end cap. In other embodiments the user-actuated dispensing means comprises a press part, septum and septum end attachment. In one embodiment user-actuated means comprises applying a pressing force against the press part.

In another embodiment there is a method for supplying a dosage of a first set of one or more ingredients, formulations or products to a second set of one or more ingredients, formulations or products comprising the steps of: (a) providing a universal inverted press part dispensing closure capable of being attached to a receiving vessel wherein the universal inverted press part dispensing closure comprises a housing having a press part, a septum, and, an end plate seal, and a first set of one or more ingredients stored within; (b) attaching the universal inverted press part dispensing closure to the receiving vessel; and (c) dispensing from the universal inverted dome dispensing closure by a user-actuated means the first set of one or more ingredients into the receiving vessel comprising a second set of one or more ingredients. In some embodiments the housing further comprises an end cap. In other embodiments the housing further comprises a septum end attachment.

In another embodiment there is a method for supplying a dosage of a first set of one or more ingredients, formulations or products to a second set of one or more ingredients, formulations or products comprising the steps of: (a) providing a universal inverted press part dispensing closure capable of being attached to a receiving vessel wherein the inverted press part dispensing closure comprises a housing having a press part, a septum, end plate seal, and a first set of one or more ingredients, formulations or products stored within; and (b) attaching the universal inverted press part dispensing closure to a receiving vessel by means of a closure radial skirt; and (c) dispensing from the universal inverted dome dispensing closure by a user-actuated means the first set of one or more ingredients, formulations or products into the receiving vessel comprising a second set of one more ingredients, formulations or products. In some embodiments the housing further comprises an end cap or a septum end attachment. In one embodiment the user-actuated means is application of a pressing force against the press part. In some embodiments the closure radial skirt comprises a proximal deck, a distal annular edge, peripheral side walls and one or more deformable depending protrusions. In another embodiment, the closure radial skirt comprises a proximal deck, a distal annular edge, peripheral side walls and a plug seal.

In another embodiment of the invention, there is a method for supplying a dosage of a first one or more products to a second one or more products comprising the steps of: (a) providing a universal inverted dome dispensing closure having a housing capable of holding a first one or more products, wherein the housing comprises a septum, a convex dome, an end plate seal, and a user-actuated means for dispensing one or more products; (b) providing a receiving vessel having a second one or more products and capable of receiving the first one or more products from the inverted dome dispensing closure; (c) attaching the universal inverted dome dispensing closure to the receiving vessel by means of closure radial skirt; and (d) dispensing by the user-actuated means the first one or more products into the receiving vessel. In some embodiments the housing further comprises an end cap. In other embodiments the housing further comprises a septum end attachment. In one embodiment the user-actuated means comprises applying a pressing force against the convex dome causing inversion of the convex dome into a concave configuration. In some embodiments there is a dose chamber capable of containing the first one or more products in the housing until dispension. In some embodiments, the closure radial skirt comprises a proximal deck, a distal annular edge, peripheral side walls and one or more deformable depending protrusions. In other embodiments, the closure radial skirt comprises proximal deck, a distal annular edge, peripheral side walls and a plug seal. In other embodiments, the closure radial skirt comprises one or more deformable depending protrusions and a plug seal. In one embodiment the universal inverted dome dispensing closure is attached to a receiving vessel by a manufacturer. In another embodiment the universal inverted dome dispensing closure is attached to the receiving vessel at the point-of-use by an end user. The universal inverted dome dispensing closure is removable and capable of being reattached from the receiving vessel by the end user.

Applications

In some embodiments, the universal dispensing closure of the present invention is designed to be filled with a first component, and used for storing the first component therein until, and supplying the first component for admixture or combination with a second component contained in a receiving vessel at, point-of-use by end user. The first and second components may be in the form single compound, mixture, solution, capsule, liquid, slurry, powder, tablet, water soluble, water dispersible, or any other containable components, ingredients, formulation or products. The first component is added to the second component by the end-user. The ability to select from an assortment of pre-packaged first components allows the end user to purchase and store first and second components separately. The first and second components may also be packaged together. The invention is useful for example, to keep non-perishable second components at room temperature, and to keep first components under appropriate, possibly separate, storage, for later addition to the second component. The present invention is useful for first components that are sensitive, like moisture-sensitive or those that interact with the second component by forming by-products that change the usefulness of the combined components, e.g., loss or change of strength or value with time after combination. The universal closure dispensing device of the present invention is useful for maintaining separation of first components that may require special storage and/or handling until just before addition to a second component, e.g., refrigeration, desiccation, or heating. The invention is also useful for adding unstable and/or sterile components to a second component, like a beverage, liquid enteral nutrition or medicine, for example, adding vitamins or beneficial gastrointestinal microorganisms to fruit juice, milk, water and medicine. Further non-limiting illustrations of how the invention is useful are provided below.

Beverages

The universal closure dispensing device can comprise ingredients useful for mixing with, adding to, preparing, or supplementing beverages, liquids or drinks of various types and uses. Non-limiting examples of some types of beverage formulations that can be prepared using the universal dispensing device include hangover prevention, rehydration, antioxidants, probiotics, immunity boosting, energy promoting, wellness promoting, daily vitamin supplements, daily mineral supplements, bone health, gut health, beauty from within, skin health, joint health, and endurance, superfruits, superfoods, superberries, botanicals, greens, herbs, extracts, prebiotics, mental acuity, weight loss, nutrient supplements, eye health, carotenoids, sports nutrition, muscle building, free amino acids, workout formulations, relaxation, anti-stress, diabetic safe, heart health, good circulation, performance, and recovery.

In one embodiment the universal closure dispensing device comprises ingredients to prepare reduced calorie beverages. In some embodiments, the beverages will comprise a non-nutritive sweetener, such as, for example, erythritol, D-tagatose, or one or more steviosides. In various aspects of the invention, the one or more steviosides are selected from the group consisting of Stevioside, Rebaudioside A, Rebaudioside B, Rebaudioside C, Dulcoside A, Rubusoside, Steviolbioside, transglucosylation derivatives thereof, Stevia extract, and combinations thereof. In certain embodiments the steviosides comprises a Stevia extract. In some embodiments, non-nutritive sweeteners are selected from aspartame, acesulfame salts, saccharins, cyclamates, sucralose, alitame, neotame, steviosides, glycyrrhizin, Lo Han Guo, neohesperidin dihydrochalcone, monatin, monellin, thaumatin, and brazzein, and the sugar alcohol is selected from sorbitol, mannitol, lactitol, maltitol, xylitol, erythritol and combinations thereof.

The types of beverages suitable for use with the universal closure dispensing device of the present invention include but are not limited to soft drinks, coffee beverages, tea beverages, powdered soft drinks, liquid concentrates, flavored waters, enhanced waters, fruit juice and fruit juice flavored drinks, and sport drinks.

It is possible to include any other ingredients typically used in reduced-calorie beverages in the universal closure dispensing device. For example, it is possible to include, without limitation, acidulants, flavors, soluble low-calorie fibers such as polydextrose, Fibersol, arabinogalactan, chitosan, chitin, xanthan, pectin, cellulosics, konjac, gum arabic, modified starch, soy fiber, inulin, inulose, hydrolyzed guar, guar gum, beta-glucan, carageenan, locust bean gum, alginate, polyglycol alginate, foam stabilizing agents such as yucca or yuccalquillaia extracts, salts such as sodium, calcium and potassium chlorides, food grade surfactants such as monoglycerides, diglycerides, lecithin and fractions thereof, and synthetic surfactants such as Tweens, Spans, diacetyltartaric esters, citric acid esters, etc.

Nutritive sweeteners can also be included in addition to, or in place of non-nutritive sweeteners. A "nutritive" sweetener is one which provides significant caloric content in typical usage amounts, i.e., more than about 4 calories per gram of dry weight. Such sweeteners include, without limitation, fructose, sucrose, dextrose, maltose, trehalose, rhamnose, corn syrups and fructo-oligosaccharides.

In another embodiment, the universal closure dispensing device can comprise ingredients useful for energy drinks or health beverages. Such ingredients can include, for example, free amino acids, vitamins, minerals and trace elements, electrolytes, simple and complex carbohydrates, and flavoring aids. Amino acids that are useful can include L-isoleucine, L-leucine, L-valine, L-lysine, L-methionine, L-phenylalanine, L-threonine, and L-tryptophan, L-alanine, L-arginine, L-aspartic acid, L-glutamic acid, L-aminoacetic acid, L-histidine, L-proline, L-serine, L-tyrosine, and L-cysteine. Nutrient factors such as vitamins and similar compounds, can be included, specifically vitamin A, vitamin D3, vitamin C, vitamin E, folic acid, thiamine, riboflavin, niacin, vitamin B6, vitamin B12, biotin, pantothenic acid, and vitamin K1. Exemplary electrolytes include sodium, potassium, magnesium and calcium. Suitable sources of the electrolytes include, but are not limited to, sodium chloride, potassium phosphate, potassium citrate, magnesium succinate and calcium pantothenate.

In another embodiment, the universal closure dispensing device can comprise ingredients useful for energy drinks or health beverages. Such ingredients can include, for example, Resveratrol, Macqui Berry, herbal extracts, hibiscus, chamomile, superfruit extract, superberry extract, iron, superfood extracts, super berry, super fruit, super foods, hyaluronic acid, hydroxy proline, alpha lipoic acid, ginseng, ginkgo, herbs, glucosamine, chondroitin, Omega 3, Omega 6, Omega 9, fatty acids, DHA, EPA, CLA, fruit flavors, exotic flavors. This could include hydrophobic ingredients made into suspensions, dispersions or made water soluble.

The ingredients may also include minerals and trace elements, including iron, magnesium, copper, zinc, manganese, selenium, molybdenum, chromium, and iodide.

These ingredients can also include carbohydrates which serve as one of the principal caloric sources, in addition to the branched-chain amino acids. The carbohydrate content of the composition can be a combination of simple and complex saccharides. The simple sugars, or monosaccharides, may be glucose, trehalose, dextrose, fructose, or corn syrup. The disaccharide can be sucrose, but other disaccharides may be used. Complex carbohydrates include polyglucose and malto-dextrin. The flavoring aids may be any conventional flavoring aids that provide a pleasant-tasting composition when combined with the remainder of the ingredients. Conventional flavoring aids include sweeteners as described herein or natural or artificial grape, cherry, lemon, lime, punch, root beer, orange, grapefruit, strawberry, and other flavorings. The suitability of any particular flavoring aid in any particular composition of the present invention may be readily ascertained by means of a simple taste test.

Another embodiment of the universal dispensing closure device of the present invention is a storage and delivery system comprising a hangover protection formulation to admix with a liquid, resulting in a hangover preventative or hangover ameliorating beverage.

In one embodiment there is the universal dispensing device of the present invention and one or more of following ingredient components selected from: ingredients for rehydration, electrolytes, vitamins, minerals, antioxidants, herbs, anti-hangover ingredients, energy components, detoxification components, or combinations thereof. In one embodiment, there is a universal dispensing device of the present invention and one or more detoxification components, one or more rehydration ingredients and one or more ingredients to restore electrolyte balance. In another embodiment, the universal dispensing device of the present invention comprises an anti-hangover formulation comprising an ingredient selected from the group consisting of one or more B vitamins, one or more energy components, one or more electrolytes, and combinations thereof. In some embodiments, the anti-hangover formulation further comprises ingredients selected from the group consisting of flavoring agents, sweetening agents, acidulants, coloring agents and combinations thereof.

In some embodiments the anti-hangover ingredients comprise one or more components having preventative effects against at least one symptom of excess alcohol consumption, including headache, dizziness, nausea, dehydration, fatigue, cotton mouth, stress, bad mood, poor appearance, or poor health. Non-limiting examples of the one or more components having preventative effects against at least one symptom of excess alcohol consumption include, for example, glucarate, a pharmaceutically acceptable salt, or enantiomer thereof or a derivative thereof selected from a group consisting of d-glucaro-1,4-lactone, d-glucuronolactone, d-glucaro-6,3-lactone, d-glucuronic acid gamma lactone, and d-glucurone, calcium glucarate, potassium glucarate, magnesium glucarate, zinc glucarate, and ferrous glucarate, glucaric acid, glucuronolactone, milk thistle extract and glutathione.

B vitamins include, for example, Vitamin $B_1$ (thiamine), Vitamin $B_2$ (riboflavin), Vitamin $B_3$ (niacin or niacinamide, sometimes also known as vitamin PP), Vitamin $B_5$ (pantothenic acid), Vitamin $B_6$ (pyridoxine, pyridoxal, or pyridoxamine, or pyridoxine hydrochloride), Vitamin $B_7$ (biotin), Vitamin $B_9$ (folic acid), Vitamin $B_{12}$ (various cobalamins; commonly cyanocobalamin).

Non-limiting examples of one or more energy components include, for example, caffeine, carbohydrates such as sugars-glucose, amino acids-proteins, fatty acids, choline, ginkgo biloba, L-glutamine, caffeine, ginseng, inositol, B vitamins, vitamin C, CoQ10, camitine, ashwarghanda, Essentra, Sendera, Sensoril, taurine, glucuronolactone, guarana, tea, ribose, NADH, and other energy boosting drink ingredients.

Electrolytes include, for example, sodium, magnesium, potassium, phosphorous in elemental and organic acid forms e.g., magnesium citrate, magnesim chloride, potassium chloride, monopotassium phosphate.

Non-limiting examples of vitamins include one or more of B vitamins, vitamin C, vitamin D, vitamin A, vitamin E, or combinations thereof.

Minerals include for example, one or more of forms of zinc, magnesium, potassium, sodium, calcium in all elemental and organic acid forms.

Antioxidants include, for example, one or more berry extracts, anthocyanins, grape seed oil, catechins, polyphenols, green coffee, green tea, matcha tea, b vitamins, CoQ10, vitamin C, zinc, vitamin E, or combinations thereof.

In some embodiments, the weight of the anti-hangover composition that is housed in the universal closure device is about 350-1500 mg, about 500-1250 mg, about 750-1000 mg, or about 800-900 mg and comprises about 0.1-5% by weight of B vitamins, about 2-25% by weight of an energy component, about 0.5-25% by weight of glucarate, a pharmaceutically acceptable salt, or enantiomer thereof or a derivative thereof, and about 40-95% by weight of electrolytes.

In some embodiments, the anti-hangover formulation comprises about 1-3% by weight of B vitamins, about 5-15% by weight of an energy component, about 3.0-15% by weight of glucarate, a pharmaceutically acceptable salt, or enantiomer thereof or a derivative thereof, and about 55-90% by weight of electrolytes. In some embodiments, the anti-hangover formulation comprises about 1-2% by weight of B vitamins, about 10-15% by weight of an energy component, about 5.0-10% by weight of glucarate, a pharmaceutically acceptable salt, or enantiomer thereof or a derivative thereof, and about 75-85% by weight of electrolytes.

In some embodiments, the B vitamins comprise about 1-3% by weight. In some embodiments, Vitamin $B_2$ is present in an amount ranging from about 0.01-0.5% 0.5% by weight, Vitamin $B_3$ is present in an amount ranging from about 0.1-1% by weight, Vitamin $B_6$ is present in an amount ranging from about 0.05-0.4% by weight, Vitamin $B_5$ is present in an amount ranging from about 0.1-1.5% by weight, and Vitamin $B_{12}$ is present in an amount ranging from about 0.0001-0.010% by weight.

In some embodiments, the energy component comprises about 2-25% by weight of the formulation. In some embodiments, the amount of the energy component is about 5-15% by weight, about 7-13% by weight or about 10-12% by weight.

In some embodiments, the glucarate (or derivative thereof) component comprises about 0.5-25% by weight of the formulation. In some embodiments, the amount of the glucarate (or derivative thereof) is about 3-15% by weight, about 5-10% by weight or about 6-8% by weight.

In some embodiments, the electrolytes comprise about 40-95% by weight of the formulation. In some embodiments, the electrolytes are about 55-90% by weight, about 70-85% by weight or about 80-85% by weight.

In some embodiments, the anti-hangover formulation comprises between about 150-700 mcg Vitamin $B_2$, between about 0.5-15 mg Vitamin $B_3$, between about 0.4-8.5 mg Vitamin $B_6$, between about 2-75 mcg Vitamin $B_{12}$, between about 1-10 mg Vitamin $B_5$, between about 25-250 mg of caffeine, between about 10-250 mg glucaronolactone, and between about 275-900 mg of electrolytes (such as magnesium chloride, potassium chloride, monopotassium phosphate, and potassium glucarate).

In some embodiments, the anti-hangover formulation comprises between about 440 mcg Vitamin $B_2$, about 5.3 mg Vitamin $B_3$, about 1.3 mg Vitamin $B_6$, about 6 mcg Vitamin $B_{12}$, about 5 mg Vitamin $B_5$, about 100 mg of caffeine, about 50 mg glucaronolactone, and about 650 mg of electrolytes (magnesium chloride, potassium chloride, monopotassium phosphate, and potassium glucarate). The anti-hangover formulation can further comprise the following ingredients selected from the group consisting of silicon dioxide, sucralose, fruit and vegetable juices, potassium, acesulfame, malic acid, citric acid, potassium D-glucarate, maltodextrin, magnesium chloride, potassium chloride, monopotassium phosphate, natural and artificial flavors, and combinations thereof.

Another embodiment of the universal dispensing closure device of the present invention is storage and delivery system to create a fiber enhanced water using either soluble or insoluble fibers (e.g. arabinogalactan, arabinoxylan, and others) independently or in combination with other ingredients, flavoring, sweetening, acidulants, and/or coloring agents.

Another embodiment of the universal dispensing closure device of the present invention is a storage and delivery system to create an immune supporting beverage using probiotics independently or in combination with other ingredients, flavoring, sweetening, acidulants, and/or coloring agents.

Another embodiment of the universal dispensing closure device of the present invention is a storage and delivery system to create beauty from within beverages using ingredients that can provide anti-aging benefits by ingestion of them within the created beverage independently or in combination with other ingredients, flavoring, sweetening, acidulants, and/or coloring agents.

Another embodiment of the universal dispensing closure device of the present invention is a storage and delivery system to create sports nutrition beverages targeting benefit areas such as recovery, stamina, strength, muscle building, etc. ingredients that can be utilized for such benefits are branched chain amino acids, L-carnitine, creatine, glutamine, proteins, hydrolyzed proteins, free amino acids, and other such ingredients independently or in combination with other ingredients, flavoring, sweetening, acidulants, and/or coloring agents.

In another embodiment, the universal dispensing closure of the present invention is useful for the creation of alternative forms or variants of existing brand beverages. Such variants include by non-limiting examples convenience forms, travel forms, dehydrated forms requiring only the addition of water, variants with an extended shelf-life, sugar-free forms, and variants with attributes of freshness, efficacy, potency, stability and consistency.

Another embodiment of the universal dispensing closure device of the present invention is the universal dispensing closure device marketed and sold separately and unattached from a receiving vessel needed to form a finished product. This has benefits in lowering shipping costs by avoiding shipping costs associated with shipping water or other liquids while also providing attributes such as freshness, convenience, efficacy, potency, consistency, for example.

Another embodiment of the universal dispensing closure device of the present invention is a storage and delivery system for ingredients that exhibit stability, solubility, and efficacy challenges when exposed to water or other liquids. Non-limiting examples of such ingredients include Glisodin (poor solubility and stability over time in water), probiotics (poor shelf life when exposed to water activity, CoQ10 (poor stability and solubility over time in water).

Another embodiment of the universal dispensing closure device of the present invention is a storage and delivery device useful to for storing flavors and/or active ingredients for later introduction to dairy or dairy alternative beverages. This embodiment of the universal disclosure device facilitates introduction of ingredients and flavor systems that will not survive heat of pasteurization, and allows for marketing of multiple flavors and ingredient solutions without the expense and scheduling of adding such flavors and ingredients directly to the manufacturing line.

Another embodiment of the universal dispensing closure device of the present invention is a storage and delivery device useful for storing flavors and/or active ingredients for later introduction to alcohol beverage. This embodiment of the universal disclosure device facilitates introduction of ingredients and flavor systems that will not survive alcohol processing or that which exhibit poor long term solubility or stability in alcohol. This embodiment would also allow for marketing of multiple flavors and ingredient solutions without the expense and scheduling of adding such flavors and ingredients directly to the manufacturing line.

Medicines

The universal closure dispensing device is useful for supplying a predetermined measured dose of liquid, water soluble, water dispersible, and water suspension pharmaceutical drugs and OTC medications. In one embodiment, the universal dispensing closure device of the present invention is a storage and delivery system for dosing medicine in admixture with a liquid for ease of consumption independently or in combination with other ingredients, flavoring, sweetening, acidulants, and/or coloring agents. In another embodiment, the universal dispensing closure device is a storage and delivery system for combining a first medicinal component to a second medicinal component and/or pharmaceutical carrier independently or in combination with other ingredients, flavoring, sweetening, acidulants, and/or coloring agents at prescribed or desired point-of-use such that the efficacy of the medicinal component is maintained. In one embodiment, the end-user combines the first and second components together. In another embodiment, a pharmacist or like technician combines the first and second components for use by the end-user. In one embodiment, there is a universal dispensing closure device comprising amoxicillin in a concentrated liquid form for eventual dissolving in water to be used in place of other forms of the medicine.

Medical, Lab and Field Test Use

The universal closure dispensing device is useful for providing a measured dose of a reactant, reagent, antibody for admixture with a substance, chemicals or sample, including environmental, biologic, organic, chemical, inorganic samples, to provide a quantitative or qualitative analysis, color metric, test result, litmus or assay of itself, the sample or a third material in the substance or sample.

Potable Water

The universal closure dispensing device can comprise ingredients useful for mixing with or adding to dirty water to prepare potable water. In one embodiment, the universal dispensing closure device of the present invention is a storage and delivery system comprising one or more antibacterial or antimicrobial agents, one or more antiparasitic agents, iodine, chlorine other water disinfecting agents, or combinations thereof, independently or in combination with other ingredients, flavoring, sweetening, acidulants, and/or coloring agents. Antibacterial agents include, for example, chlorine and antibiotic drugs like aminoglycosides, amoxicillin, ansamycins, beta-lactams, carbacephems, cephalosporins, fluoroquinilones, glycopeptides, macrolides, monobactams, nitrofurans, oxazolidinones, penicillins, quinolones, rifamycins, tetracyclines, sulphonamides, drugs against myobacteria and combinations thereof.

Cosmetics

The universal closure dispensing device is useful for the sequestering of materials until a desired point-of-use for mixing with, adding to, preparing health and beauty products, spa products or cosmetics. In one embodiment, the universal dispensing closure device of the present invention is a storage and delivery system comprising one or more hair colorants, bleachers, lighteners, conditioners, moisturizers, or combinations thereof.

Cleaning Products

The universal closure dispensing device can comprise concentrated cleaning ingredients useful for mixing with and adding to water to prepare cleaning solutions. In one embodiment, the universal dispensing closure comprises a glass cleaner or all purpose cleaner in concentrated form in cap for later introduction into water for use in cleaning. The cleaning chemicals that can be dispensed using the universal closure can be used in such places as homes, schools and places of business on an everyday basis. Depending upon the ingredients, they may be toxic or safe. The cleaning ingredients can include, but are not limited to, a strong alkali, heavy-duty alkali, mild alkali, strong acid, mild acid, solvent, soaps and detergents.

EXAMPLES

Example 1

The POWERCAP® in one form comprises: a housing and a closure radial skirt having more than one inner diameter and having more than one spacer rib and more than one thread engagement lug on the outer most internal diameter the housing comprising a dose chamber and a user-actuated means for dispensing one or more products and an end plate seal; the user-actuated means comprising a convex dome, septum and end cap; the convex dome further comprising a standing radial rim; the closure radial skirt further comprising a tamper evident skirt.

Example 2

Many nutrients and vitamins that can be used to create functional beverages are sensitive to the conditions most often utilized to manufacture and store such products (i.e. heat, light, water). The POWERCAP® dosing closure is a beverage technology that can protect ingredients in an enclosed chamber with a friction fit seal that can be engaged to dispense stored materials into liquid to create a functional beverage at the time of use. This experiment investigated the ability of the POWERCAP® dosing closure to retain the chemical integrity of vitamin C (ascorbic acid) and caffeine as compared to subjecting those nutrients to the conditions typical of hot fill beverage manufacturing. A standard formulation, containing known quantities of both vitamin C and caffeine, was distributed among four experimental conditions: 1) within the POWERCAP® chamber and stored without attachment to a bottle; 2) within the POWERCAP® chamber and stored fully threaded onto a standard form threaded bottle filled with water; 3) dispensed into a water volume and stored in a capped bottle; and 4) dispensed into a water volume, heated to 80° C. for 30 minutes, and stored in a capped bottle. Each of the test samples was stored in an oven at 37° C. for 30 days. At periodic interim time points, replicates were pulled from their storage conditions and evaluated by high performance liquid chromatography coupled to photodiode array and mass detectors to determine the quantity of vitamin C and caffeine retained in each. This process was repeated at the end of the 30 day experiment. Caffeine displayed strong stability under all experimental conditions. Vitamin C stability was dependant on the storage experimental conditions. Steep degradation was observed for vitamin C when mixed with water and exposed to hot fill conditions and also in extended liquid storage without hot fill temperatures. However excellent chemical stability of vitamin C was obtained when the mix was kept dry stored in POWERCAP®, off the bottle or attached to a water filled bottle. Our results demonstrate that vitamin C, a very labile nutrient easily degraded in solution, can stay stable in the dry form, even if subjected to temperature stress conditions (37° C.).

Example 3

The universal dispensing closure device in one form comprises a housing and a closure radial skirt, and a product for preventing or ameliorating one or more symptoms of a hangover from excess ethanol consumption. The housing comprises a user-actuated means for dispensing the product and a dose chamber. The user-actuated means for dispensing comprises a convex dome, septum and end cap. The convex dome has a standing radial rim extending from the proximal radial edge of the housing tube upward beyond the apex of the convex dome to protect the convex dome from inadvertent depression and dispension of product. The closure radial skirt comprises a plug seal and a depending helix protrusion. The closure radial skirt further comprises a tamper evident skirt.

The product for preventing the onset of a hangover comprises one or more components selected from one or more anti-hangover ingredients, one or more B vitamins, one or more energy components, one or more electrolytes, or combinations thereof. In one embodiment, the universal dispensing closure comprises the anti-hangover component glucaronolactone, vitamins B2, B3, B6, B12, and B5, the energy component caffeine, and electrolytes comprising magnesium chloride, potassium chloride, monopotassium phosphate and potassium glucarate.

Example 4

It is desirable to fit a devise to the top of multiple beverage bottles to supply a predetermined dose of product. It is also an advantage to provide a sealing and retaining method once the dose or supply has been delivered to the main receptacle or vessel. Current market conditions for flat water are such that manufacturers and suppliers of these beverages have a variety of neck finishes of various dimensions. It is desirable to allow the temporary placement of a closure to these various threaded neck openings. It is also desired to have the closure act in sealing engagement to the bottle at point of use allowing the consumer to shake ingredients in order to mix thoroughly and travel about with said closure.

A dispensing closure used to house or carry the dose or supply that when activated delivers the dose and allows the end user to dispense the product as desired. The closure can be pressed on to the neck finish or screwed on by which deformable axial ribs engage interfere with the bottle threads to provide removal resistance. A depending radial protrusion of varying dimension provides sealing engagement to neck finishes of differing diameters.

A dispensing closure used to house a secondary supply or dose of product when the closure is activated the secondary product or dose is dispensed into the main vessel to which it is attached. The inverted dome is a one piece delivery method to supply a dose of product into a vessel to which it is attached. The closure dome is configured with a septum and a thinner convex dome, and an end plate seal. The end plate seal can be made from a variety materials that are thin pliable and frangible in nature to provide a sealing interface with the interior of product house when assembles. When the thinned convex dome is inverted to a concave shape the integrally molded septum applies force against the end plate shearing and fracturing the end plate and forcing the said end plate outwardly from cylindrical engagement with the main closure. This action provides a spaced apart section in the closure to allow the predetermined product or dose to fall from the closure into the attached vessel. Various bottle manufacturers use a variety of bottle openings these openings are unique and require a specific threaded closure to accommodate a shipping and long term storage seal. The Universal closure has depending ribs placed in separation to provide application and removal torque. The ribs are thin and deformable such that the closure can accept a variety of threaded neck opening diameters and thread profiles. The thin deformable ribs are compliant through there vertical length and will shear readily from the top wall to provide a hinged deformable member with the side wall of said closure.

The closure is also configured with a depending plug like sealing member. The sealing member is unique in its configuration such that it provides sealing engagement opportunities to a multiplicity of flat water bottle neck finish inside diameters. The plug seal has a longer and thinner section that can be readily folded or deformed out of location providing interfering engagement for larger ID bottles and an upper most radial sealing member for smaller bottle ID bottles. The concept can be improved be creating a multiplicity of sealing beads or features from the smaller diameters at the distal end with increasing diameters moving up the depending wall towards the closure deck.

The closure plug seal configuration can be arranged in an angular fashion to provide sealing engagement to smaller ID bottles at the lower end of the plug seal and interfering engagement to the bottle ID at the upper end of the plug seal for larger ID bottles.

The concept can be improved by adding a tear away protective portion which extends above the apex of the dome to prevent accidental inversion of the dome. The tear away band can be configured to extend from the cylinder to which the dome is attached or from the deck portion of the cap. The concept can also be provided with a removal protective over-cap to protect against accidental inversion of the dome.

The concept can be improved to include a foil sealing portion spanning across the closure's outer most diameter as an added barrier improving freshness.

The concept can be improved by adding a septum end attachment. This separate attachment is used to capture a foil seal type of end plate. The septum end attachment is configured in a manner to apply uneven pressure on the end plate to reduce the force required to fracture or open the end plate. The septum end attachment is generally reduced in diameter from the dose chamber to allow free movement of the septum and dome inversion. The septum end is configured to include a radial bead and is largely cupped in configuration. Once the dome is inverted and septum end attachment acts against the end plate in sufficient force to break away the seal plate. The seal plate being flexible enough to accept the cup shaped septum end attachment and hold the flexible seal within the radial beads positioned to the inside of the cupped end of the septum end attachment.

While the invention has been described in connection with the disclosed embodiments, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A universal dispensing closure device comprising:

a. a housing; and b. a closure radial skirt;

wherein the housing comprises a proximal top, a distal base and side walls, a dose chamber and a user-actuated means for dispensing one or more ingredients, wherein the user-actuated means comprises a convex press part located at the proximal top of the housing, wherein the convex press part is capable of flexing to a concave configuration when force is applied, wherein the convex press part is attached to a septum, wherein the septum depends from the apex of the convex press part toward the base of the housing, wherein the septum maintains axial alignment within the housing, wherein one or more ingredients are dispensed with no twisting motion, wherein a distal end of the septum is in mating engagement with an end cap, wherein the end cap is in interfering engagement with an inside diameter of side walls of the housing sufficient to provide sealing integrity, wherein the end cap and internal side walls of the housing are made of highly polished mating surfaces, wherein the press part is configured with a plurality of radial hinge elements placed at an upper radial edge of the housing and at an upper radial edge of the septum, wherein the radial hinges are configured in a manner to allow the press part to flex to a maximum inverted position and remain in a concave configuration, wherein the press part when inverted to a concave configuration results in the septum moving vertically downward pressing the end cap from its assembled position below the distal base of the housing, releasing one or more ingredients from the dose chamber; wherein the closure radial skirt comprises one or more deformable depending protrusions.

2. The device of claim 1, wherein the distal base of the housing comprises an end plate seal.

3. The device of claim 1, wherein the housing is tubular in shape.

4. The device of claim 1, wherein the convex press part further comprises one or more radial ribs, one or more axial ribs or combinations thereof.

5. The device of claim 1, wherein the convex press part comprises a convex dome or a frustum cone.

6. The device of claim 5, further comprising a fold away truss straddling the press part to prevent inadvertent user actuation means of dispensing.

7. The device of claim 6, wherein the fold away truss folds out of the way pivoting on two hinged members connected to the outer diameter of the housing.

8. The device of claim 7, wherein the fold away truss has an inner radius such that when tab is in a folded position the tab interferes with the outer diameter of the housing.

9. The device of claim 7, wherein the fold away truss has a break-away attachment connecting the underside of the truss to the distal edge of the convex press part.

10. The device of claim 9, wherein the break-away attachment connects at the apex of the convex press part.

11. The device of claim 5, further comprising a removable protective overcap covering the convex press part.

12. The device of claim 11, wherein the removable protective overcap is connected to the device by a hinge attachment.

13. The device of claim 5, further comprising a standing radial rim attached to the proximal radial edge of the housing and extending beyond the proximal end of the convex press part.

14. The device of claim 13, wherein the standing radial rim comprises a pull tab to remove the standing radial rim before actuation.

15. The device of claim 1, wherein the dose chamber is capable of storing one or more ingredients.

16. The device of claim 1, wherein the user-actuated means for dispensing further comprises an end plate seal.

17. The device of claim 16, wherein the septum has center flash spacing.

18. The device of claim 16, wherein the end plate seal comprises a foil liner.

19. The device of claim 18, wherein the foil liner is supported across its face by plastic lining.

20. The device of claim 1, wherein the end cap comprises an end cap recess.

21. The device of claim 20, further comprising center flash spacing.

22. The device of claim 1, further comprising an end plate seal.

23. The device of claim 1, wherein the end cap is in mating engagement with the base of the septum.

24. The device of claim 1, wherein the end cap is in interfering engagement with the inner diameter of the housing.

25. The device of claim 1, wherein the end cap in an inactivated position sits proximal to the distal annular edge of housing.

26. The device of claim 1, wherein the septum end attachment is attached to the distal end of the septum and comprises one or more radial beads.

27. The device of claim 1, wherein the closure radial skirt is attached to the outer diameter of the housing, in axial alignment with the housing and has a greater outer diameter than the housing, a proximal deck, and distal annular edge.

28. The device of claim 1, wherein the deformable depending protrusions of the closure radial skirt comprise more than one depending rib placed in separation on the inner diameter of the closure radial skirt.

29. The device of claim 28, wherein the depending ribs are axial ribs.

30. The device of claim 29, wherein the axial ribs are vertical, angled, arced or combinations thereof.

31. The device of claim 28, wherein the depending ribs are radial.

32. The device of claim 1, wherein the deformable depending protrusions of the closure radial skirt are deformable rings, helix or a combination thereof.

33. The device of claim 1, further comprising a depending plug seal.

34. The device of claim 33, wherein the plug seal further comprises one or more sealing beads.

35. The device of claim 1, further comprising more than one spacer rib.

36. The device of claim 1, further comprising more than one thread engagement lug.

37. The device of claim 1, wherein the closure radial skirt further comprises one or more thinning ribs.

38. The device of claim 1, further comprising a tamper evident skirt removably attached to the distal annular edge of the closure radial skirt.

39. The device of claim 1, further comprising a receiving vessel containing another set of one or more ingredients.

40. The device of claim 39, wherein the receiving vessel is a bottle.

41. A universal dispensing closure device comprising:

a. a housing comprising a dose chamber, a proximal top, a distal base and side walls and a user-actuated means for dispensing one or more ingredients, wherein the user-actuated means comprises a convex press part located at the proximal top of the housing, wherein the convex press part is capable of flexing to a concave configuration when force is applied, wherein the convex press part is attached to a septum, wherein the septum depends from the apex of the convex press part toward the distal base of the housing, wherein the septum maintains axial alignment within the housing wherein a distal end of the septum is in mating engagement with an end cap, wherein the end cap is in interfering engagement with an inside diameter of side walls of the housing sufficient to provide sealing integrity, wherein the end cap and internal side walls of the housing are made of highly polished mating surfaces, wherein the press part is configured with a plurality of radial hinge elements placed at an upper radial edge of the housing and at an upper radial edge of the septum, wherein the radial hinges are configured in a manner to allow the press part to flex to a maximum inverted position and remain in a concave configuration;

b. a closure radial skirt comprising a plug seal and a helix deformable depending protrusion; and c. one or more ingredients selected the group consisting of one or more components having preventative effects against at least one symptom of excess alcohol consumption; one or more B vitamins; one or more energy or stimulant components; one or more electrolytes and combinations thereof, wherein the press part when inverted to a concave configuration results in the septum moving vertically downward pressing the end cap from its assembled position below the distal base of the housing, releasing one or more ingredients from the dose chamber.

* * * * *